US006868835B2

(12) United States Patent
Tsubouchi

(10) Patent No.: US 6,868,835 B2
(45) Date of Patent: Mar. 22, 2005

(54) INTERNAL COMBUSTION ENGINE

(75) Inventor: Masanori Tsubouchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/702,719

(22) Filed: Nov. 6, 2003

(65) Prior Publication Data

US 2004/0139940 A1 Jul. 22, 2004

(30) Foreign Application Priority Data

Jan. 17, 2003 (JP) ..... 2003-010417
Jan. 17, 2003 (JP) ..... 2003-010419

(51) Int. Cl.[7] ..... F01L 13/08; F01L 1/18; F02F 1/38; F02M 37/04

(52) U.S. Cl. ..... 123/508; 123/182.1; 123/90.6

(58) Field of Search ..... 123/508, 182.1, 123/196 W, 90.31, 90.6

(56) References Cited

U.S. PATENT DOCUMENTS

| | | | | |
|---|---|---|---|---|
| 2,054,928 A | | 9/1936 | Church | |
| 5,816,208 A | * | 10/1998 | Kimura | 123/182.1 |
| 5,829,414 A | * | 11/1998 | Tsunoda et al. | 123/508 |
| 6,082,336 A | * | 7/2000 | Takahashi et al. | 123/508 |
| 6,374,792 B1 | * | 4/2002 | Suzuki et al. | 123/182.1 |
| 6,386,168 B2 | * | 5/2002 | Suzuki et al. | 123/182.1 |
| 6,513,504 B2 | * | 2/2003 | Ikuma | 123/509 |

FOREIGN PATENT DOCUMENTS

| | | |
|---|---|---|
| JP | 03-003904 | 1/1991 |
| JP | 03172513 | 7/1991 |
| JP | 06280530 | 10/1994 |
| JP | 2000-227064 | 8/2000 |

* cited by examiner

*Primary Examiner*—Weilun Lo
(74) *Attorney, Agent, or Firm*—Carrier, Blackman & Associates, P.C.; Joseph P. Carrier; William D. Blackman

(57) ABSTRACT

A multicylinder internal combustion engine has a valve chamber containing a valve train for opening and closing intake valves and exhaust valves, and decompression mechanisms. First, second and third cylinders are arranged in a row parallel to an axial direction parallel to the axis of a camshaft. An exhaust cam for opening and closing the exhaust valve, which is opened and closed by the decompression mechanism, for the second cylinder is not coincident with respect to the axial direction with an abutment end of the exhaust valve with which a rocker arm driven by the exhaust cam comes into contact, and is coincident with respect to the axial direction with the decompression mechanism. Thus, a space for placing the decompression mechanism is secured while suppressing increase in the length of the camshaft and in the longitudinal size of the valve chamber. Consequently, the internal combustion engine can be formed in compact construction. Interference between the pump cam and the decompression mechanism can be avoided and increase in the length of the camshaft can be suppressed by disposing the centrifugal weight of the decompression mechanism for the third cylinder at a specific position on the side of the cam lobe of the pump cam as viewed in the axial direction.

9 Claims, 10 Drawing Sheets

INTERNAL COMBUSTION ENGINE

BACKGROUND OF THE INVENTION

1. Field of the Invention

The present invention relates to an internal combustion engine provided with a decompression mechanism incorporated into a camshaft included in a valve train and disposed in a valve chamber. The internal combustion is intended for use as, for example, an outboard engine.

2. Description of the Related Art

A multicylinder internal combustion engine intended for use as an outboard engine disclosed in, for example, JP2000-227064A (FIGS. 4 and 5) is a two-cylinder internal engine provided with a decompression mechanism to facilitate an engine starting operation. This two-cylinder internal combustion engine is provided with a camshaft disposed in a cam chamber defined by a cylinder head and a cylinder head cover, intake and exhaust cams formed on the camshaft to operate intake valves and exhaust valves, rocker arms driven for a rocking motion by the intake and exhaust cams, a decompression lever mounted on the camshaft so as to be turnable in a vertical plane under the exhaust cams, and a fuel pump. In this internal combustion engine, the exhaust cam in contact with the contact part of the rocker arm, and the end of the stem of an exhaust valve in contact with the pushing part of the rocker arm are at the same position with respect to a direction parallel to the axis of the camshaft, and hence the rocker arm extends perpendicularly to the axis of the camshaft. The decompression lever has an upper part provided with a decompression cam, and a lower part provided on its opposite sides with weights. The weights are moved radially outward by centrifugal force as the engine speed increases.

A multicylinder internal combustion engine, intended for use as an outboard engine, disclosed in JP3-3904A is a three-cylinder internal combustion engine provided with a camshaft supported in four camshaft bearings on a cylinder head forming a valve chamber, and cams formed on the camshaft to rock rocker arms (hereinafter referred to as "valve cams"). In this multicylinder internal combustion engine, the valve cam in contact with the contact part of the rocker arm, and the end of the stem of an intake or exhaust valve in contact with the pushing part of the rocker arm are at the same position with respect to a direction parallel to the axis of the camshaft, and hence the rocker arm extends perpendicularly to the axis of the camshaft. This known three-cylinder internal combustion engine has the camshaft, the valve cams, and a fuel pump driven by a driven rod driven for axial movement by an eccentric cam formed on the camshaft. The fuel pump is attached to a side surface of the cylinder head.

It is difficult to secure an axial space for mounting a decompression lever mentioned in JP3-3904A on the camshaft extending across the three cylinders of the internal combustion engine disclosed in JP3-3904A. Consequently, the length of the camshaft needs to be increased and thereby the axial length of the valve chamber needs to be increased accordingly.

As mentioned in JP3-3904A, the driven rod serving as a pump-operating member in contact with the eccentric cam, i.e., a pump drive cam, is used to transmit the driving force of the eccentric cam to the fuel pump. When the decompression lever mentioned in JP2000-227064A is disposed contiguously with the pump drive cam, the decompression lever and the pump drive cam must be arranged so that the swinging decompression lever may not interfere with the pump-operating member. Consequently, the length of the camshaft needs to be increased and thereby the axial length of the valve chamber needs to be increased accordingly.

The present invention has been made in view of such circumstances and it is therefore an object of the present invention to secure a space for placing a decompression mechanism in an internal combustion engine without increasing the length of a camshaft extending across three or more cylinders and the axial size of a valve chamber, and to form a multicylinder internal combustion engine in compact construction. Another object of the present invention is to ensure stable operation of a valve train included in a multicylinder internal combustion engine during the operation of the multicylinder internal combustion engine at high engine speeds.

A further object of the present invention is to avoid interference between a pump drive cam and a decompression mechanism, suppressing increase in the length of a camshaft extended in a valve chamber and provided with a pump drive cam and decompression mechanisms and in the axial size of the valve chamber, and to form a multicylinder internal combustion engine in compact construction.

SUMMARY OF THE INVENTION

According to one aspect of the present invention, an internal combustion engine comprises: three or more cylinders arranged in parallel; a crankshaft driven for rotation by pistons that reciprocate in the cylinders; a camshaft supported for rotation, and interlocked with the crankshaft and extending across all the cylinders: a valve chamber forming member forming a valve chamber to contain the camshaft; a valve train disposed in the valve chamber to open and close intake valves and exhaust valves; and decompression mechanisms, respectively for the cylinders, arranged in the valve chamber to open the intake valves or the exhaust valves during a compression stroke; wherein the valve train includes the camshaft, and valve cams formed on the camshaft for the cylinders to open and close the intake valves and the exhaust valves through valve-operating members, a specific one corresponding to a specific one of the cylinders among the valve cams is located at a position not coincident with respect to an axial direction parallel to the axis of the camshaft with a position where an abutment portion, in contact with the valve-operating member, of the intake or the exhaust valve is located, and the decompression mechanism for the specific cylinder is located at a position coincident with respect to the axial direction with the position of the abutment portion of the intake or the exhaust valve.

Since the specific valve cam for the specific cylinder among the cylinders arranged in a row can be disposed at a position not coincident with respect to the axial direction with the abutment portion, in contact with the valve-operating member, of the intake or the exhaust valve regardless of the axial position of the abutment portion of the intake or the exhaust valve, a space formed by spacing the specific valve cam with respect to the axial direction from the abutment portion of the intake or the exhaust valve is available for disposing the decompression mechanism so as to be coincident with respect to the axial direction with the abutment portion of the intake or the exhaust valve.

Consequently, the present invention has the following effects. Since the valve train includes the valve cams formed on the camshaft to open and close the intake and the exhaust valves for the cylinders through the valve-operating members, the specific valve cam for opening and closing the intake or the exhaust valve to be opened and closed by the decompression mechanism for the specific cylinder is not coincident with respect to the axial direction with the abutment portion, in contact with the valve-operating member, of the intake or the exhaust valve, and the decompression mechanism is coincident with respect to the axial direction with the abutment portion of the intake or the exhaust valve, and the space formed by spacing the specific valve cam with respect to the axial direction from the abutment portion is available for disposing the decompression mechanism so as to be coincident with respect to the axial direction with the abutment portion of the intake or the exhaust valve, a sufficient space is available for disposing the decompression mechanism, increase in the length of the camshaft extending across the three or more cylinders and in the longitudinal size of the valve chamber can be suppressed, and the multicylinder internal combustion engine can be formed in compact construction.

Typically, the specific cylinder is an intermediate one of the cylinders.

According to the present invention, the specific valve cam may be offset toward the cylinder adjacent to the specific cylinder relative to the abutment portion of the intake or the exhaust valve, and a part of the camshaft, extending between the specific valve cam or the decompression mechanism for the specific cylinder, and the valve cam or the decompression mechanism for the cylinder adjacent to the specific cylinder, may be not supported in any camshaft bearing.

Thus, a space available for disposing the specific valve cam at the position offset relative to the abutment portion of the intake or the exhaust valve can be formed around the abutment portion, not supported in any camshaft bearing, of the camshaft.

Consequently, increase in the length of the camshaft and in the longitudinal size of the valve chamber can further effectively be suppressed, and the multicylinder internal combustion engine can be formed in further compact construction.

Typically, the specific cylinder may be an intermediate one of the cylinders, a part of the camshaft, extending between the specific valve cam or the decompression mechanism for the specific cylinder, and the valve cam or the decompression mechanism for one of the two cylinders on the opposite sides of the specific cylinder, may be not supported in a camshaft bearing, and another part of the camshaft, extending between the specific valve cam or the decompression mechanism for the specific cylinder, and the valve cam or the decompression mechanism for the other one of the two cylinders on the opposite sides of the specific cylinder, may be supported for rotation in a camshaft bearing.

Omission of a camshaft bearing for supporting the part of the camshaft between the middle cylinder and one of the adjacent cylinders provides an effect similar to the aforesaid effect, and the support of the part of the camshaft between the middle cylinder and the other adjacent cylinder in the camshaft bearing further effectively prevents the deformation of the camshaft under a load placed on the valve cams even during the high-speed operation of the camshaft.

Consequently, the present invention has the following effects. Omission of a camshaft bearing for supporting the part of the camshaft between the valve cam or the decompression mechanism for the middle cylinder and the valve cam or the decompression mechanism for one of the adjacent cylinders provides an effect similar to the aforesaid effect, the support of the part of the camshaft between the middle cylinder and the other adjacent cylinder in the camshaft bearing further effectively prevents the deformation of the camshaft under a load placed on the valve cams to ensure the stable operation of the valve train even during the high-speed operation of the multicylinder internal combustion engine.

Preferably, the valve cam or the decompression mechanism for the specific cylinder is disposed adjacently to the valve cam or the decompression mechanism for a cylinder adjacent to the specific cylinder.

When the valve cam or the decompression mechanism for the specific cylinder is thus disposed, any structure, such as a journal, that obstructs the close arrangement of the valve cams or the decompression mechanisms for the specific and the adjacent cylinder is not formed in the part of the camshaft between the valve cam or the decompression mechanism for the specific cylinder, and the valve cam or the decompression mechanism for the adjacent cylinder, and hence a sufficient space is available for the decompression mechanism.

Consequently, the following effects are obtained. Since the camshaft is provided with the valve cam or the decompression mechanism for the specific cylinder adjacently to the valve cam or the decompression mechanism for the adjacent cylinder, a sufficient space is available for placing the decompression mechanism. Therefore, increase in the length of the camshaft and the size of the valve chamber can be further effectively suppressed, and the multicylinder internal combustion engine can be formed in a further compact construction.

According to the present invention, the multicylinder internal combustion engine further comprises a fuel pump attached to the valve chamber forming member forming the valve chamber, the camshaft is provided with a specific one of the decompression mechanisms, and a pump cam having a cam surface with which a pump-operating member for driving the fuel pump comes into contact to drive the fuel pump, the specific decompression mechanism is provided with a centrifugal weight supported on the camshaft for turning and positioned adjacent to the pump cam with respect to the axial direction parallel to the axis of the camshaft, the centrifugal weight is on the side of the cam surface of the pump cam as viewed in the axial direction, and the centrifugal weight turns toward the axis of the camshaft so as to approach a tip part of a cam lobe defined by the cam surface of the pump cam as the rotational speed of the camshaft increases.

When the engine speed increases after the multicylinder internal combustion engine has been started, the centrifugal weight disposed on the side of the cam lobe turns toward the tip part, remotest from the axis of the camshaft, of the cam lobe of the pump cam. Therefore, a turning range in which the centrifugal weight turns to a position where the centrifugal weight overlaps the cam lobe as viewed in the axial direction is wider than a turning range in which the centrifugal weight would turn radially if the centrifugal weight were disposed at a position other than that on the side of the cam lobe.

Consequently, the following effects are obtained. Since the centrifugal weight turns in a wide range to the position where the centrifugal weight overlaps the cam lobe as viewed in the axial direction, the pump cam and the decompression mechanism can be disposed close to each other without causing interference between the centrifugal weight and the pump-operating member for driving the fuel pump. Therefore, increase in the length of the camshaft and in the longitudinal size of the valve chamber can be suppressed, and the multicylinder internal combustion engine can be formed in compact construction.

According to the present invention, the multicylinder internal combustion engine further comprises a fuel pump attached to the valve chamber forming member forming the valve chamber, the camshaft is provided with a specific one of the decompression mechanisms, and a pump cam having a cam surface with which a pump-operating member for driving the fuel pump comes into contact to drive the fuel pump, the specific decompression mechanism is provided with a centrifugal weight supported on the camshaft for radial movement at a position near the pump cam with respect to the axial direction parallel to the axis of the camshaft, the centrifugal weight moves in a range corresponding to a cam lobe defined by the cam surface of the pump cam as viewed in the axial direction.

When viewed in the axial direction, the centrifugal weight does not jut outside the cam surface with which the valve-operating member comes into contact.

Consequently, the following effects are obtained. Since the centrifugal weight does not jut outside the cam surface as viewed in the axial direction, the pump cam and the decompression mechanism can be disposed close to each other without causing interference between the centrifugal weight and the pump-operating member for driving the fuel pump in the set turning range of the centrifugal weight. Therefore, increase in the length of the camshaft and in the longitudinal size of the valve chamber can be suppressed, and the multicylinder internal combustion engine can be formed in compact construction.

In this specification, unless otherwise specified, "axial direction" signifies a direction parallel to the axis of the camshaft.

DESCRIPTION OF THE PREFERRED EMBODIMENTS

Preferred embodiments of the present invention will be described with reference to FIGS. 1 to 10.

Figure 1:
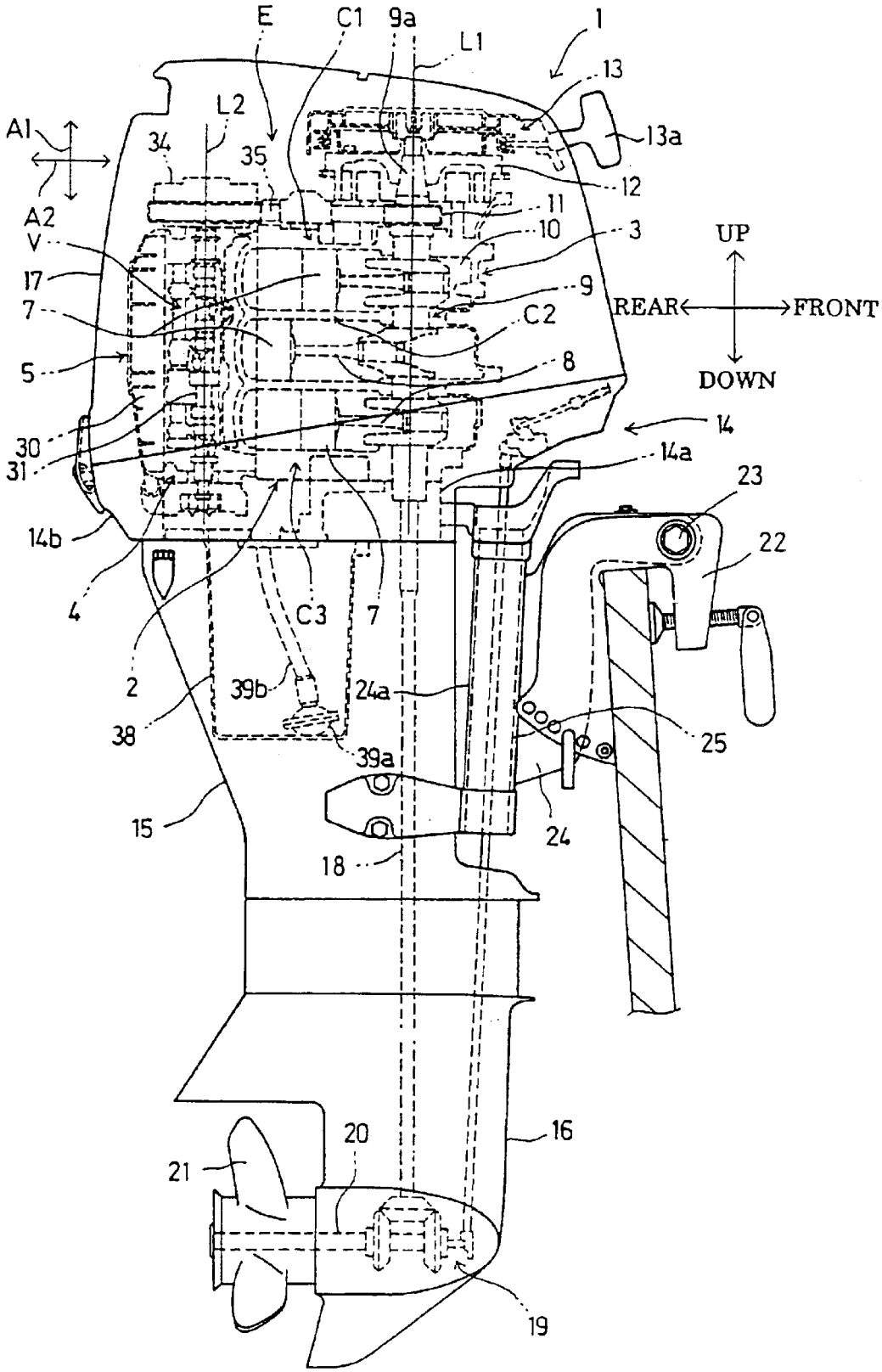
FIG. 1 is a schematic, right-hand side elevation of an outboard engine including an internal combustion engine in a preferred embodiment of the present invention.

Referring to FIG. 1 showing the right side of an outboard engine 1 employing an internal combustion engine E in a preferred embodiment of the present invention in a schematic side elevation, the internal combustion engine E is a vertical internal combustion engine having a crankshaft extending with its axis L1 in a vertical position. More specifically, the internal combustion engine E is a three-cylinder in line overhead-camshaft water-cooled four-stroke cycle vertical internal combustion engine.

Figure 2:
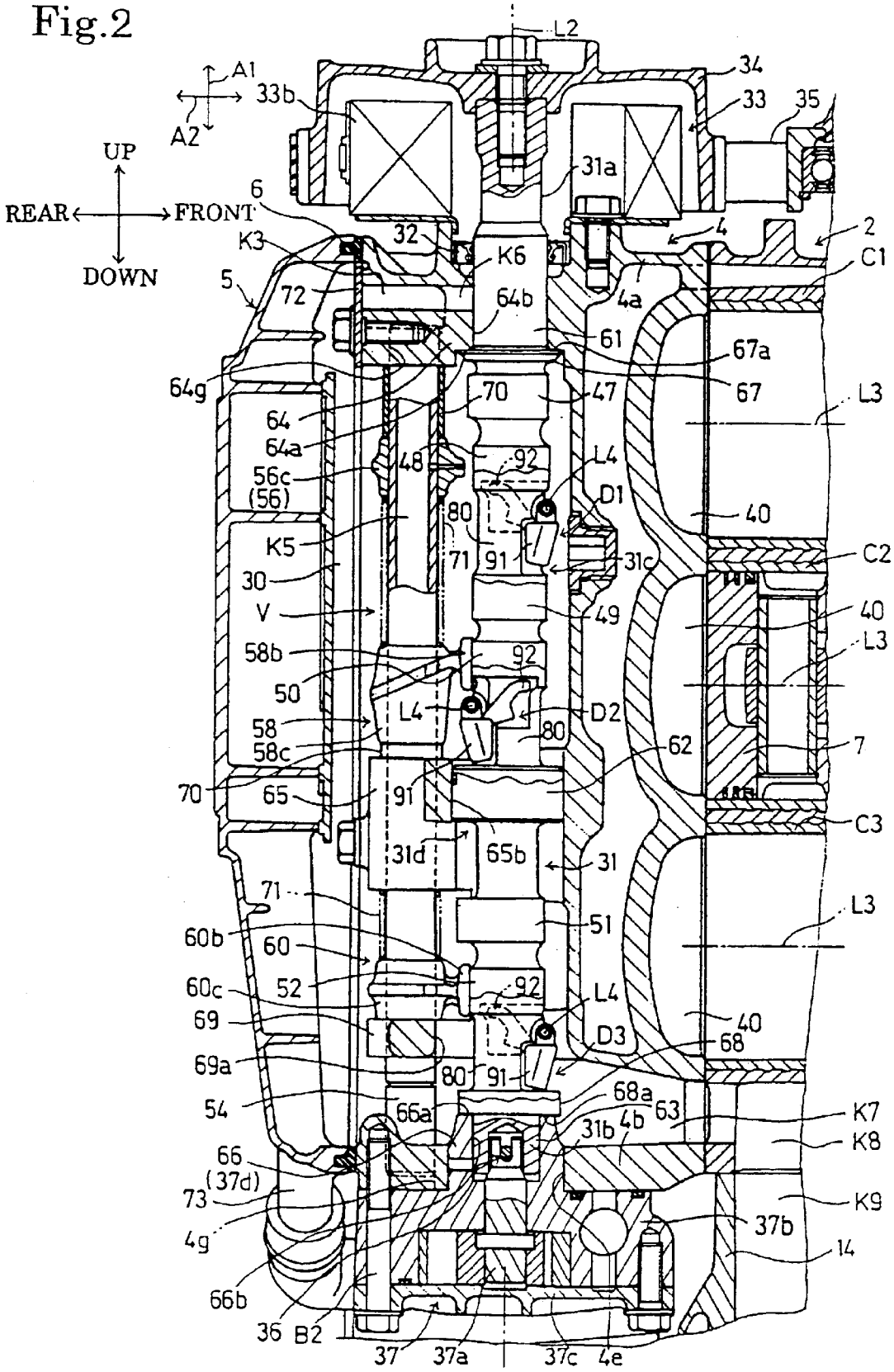
FIG. 2 is a sectional view taken on the line II—II in FIG. 3.
Figure 3:
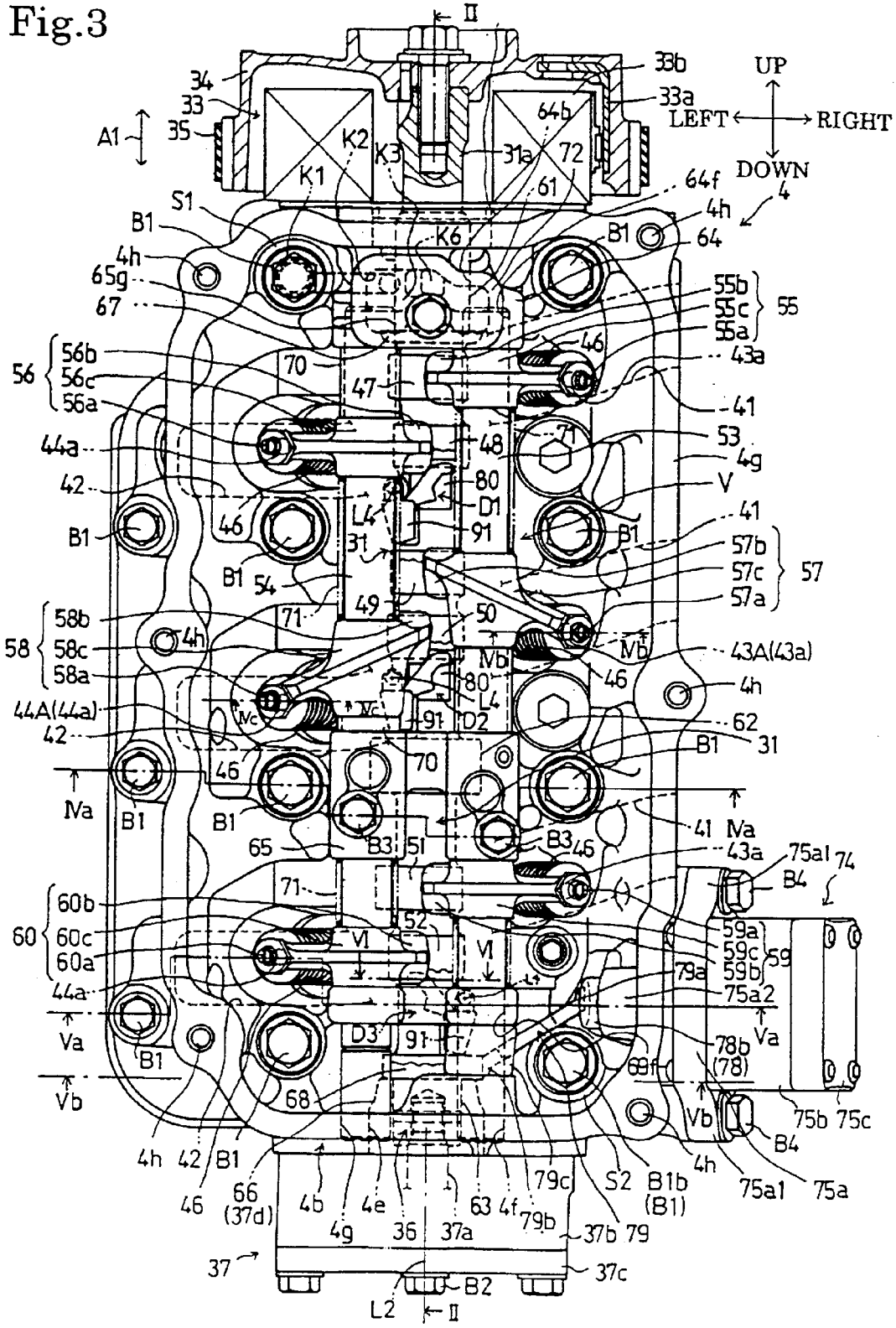
FIG. 3 is a rear view of a cylinder head included in the internal combustion engine shown in FIG. 1 with a head cover removed.

The internal combustion engine E has a cylinder block 2 provided with a first cylinder C1, a second cylinder C2 and a third cylinder C3, a crankcase 3 fasted to the front end of the cylinder block 2 with a plurality of bolts, a cylinder head 4 fastened to the rear end of the cylinder block 2 with a plurality of bolts B1 (FIGS. 3 and 4), and a head cover 5 fastened to the sealing surface 4*g* (FIG. 3) of the rear end of the cylinder head 4 with an annular sealing member 6 (FIG. 2) held between the rear end of the cylinder head 4 and the head cover 5 in close contact with the sealing surface 4*g* by screwing a plurality of bolts in threaded holes 4*h* (FIG. 3).

In this embodiment, words including up, upward, down, downward, front, forward, rear, rearward, right, rightward, left, leftward and such are used to express positions, sides, directions and such in connection with the front end, the rear end, the right side, the left side and such of a ship on which the outboard engine 1 is mounted. Thus, an upward direction is one of opposite axial directions A1 parallel to the axis L2 of a camshaft 31, a downward direction is the other of the opposite axial directions A1, a forward direction is one of the opposite directions A2 parallel to the axes L3 (FIG. 2) of the cylinders C1 to C3, and a rearward direction is the other of the opposite directions A2. A side, on which intake valves 43 are arranged, on one side of a reference plane including the axes L3 of the cylinders and parallel to the camshaft 31 or the axis L1 of the crankshaft 9 is called an intake side, and a side, on which exhaust valves 44 are arranged, on the other side of the reference plane is called an exhaust side.

Pistons 7 fitted for reciprocation in the cylinders C1 to C3 are connected to the crankshaft 9 by connecting rods 8. The crankshaft 9 is disposed in a crank chamber 10 defined by a front part of the cylinder block 2 and the crankcase 3 and is supported for rotation by main bearings on the cylinder block 2 and the crankcase 3. A crankshaft pulley 11, a flywheel 12 serving also as a flywheel magnet, and a recoil starter 13 provided with a starter knob 13*a* and serving as a starting device are mounted and arranged on an upper end part 9*a* of the crankshaft 9 projecting upward from the crank chamber 10 in that order upward.

A lower engine case 14 has a mount case 14*a* and an under case 14*b*, which are formed integrally. The cylinder block 2 is joined to the mount case 14*a*. The upper end of an extension case 15 is joined to the lower end of the lower engine case 14. A gear case 16 is joined to the lower end of the extension case 15. The under case 14*b* of the lower engine case 14 covers a lower part of the internal combustion engine E and the mount case 14*a*. An upper engine cover 17 is joined to the upper end of the lower engine case 14 with a sealing member held between the upper engine cover 17 and the upper end of the lower engine case 14. The upper engine cover 17 covers an upper part of the internal combustion engine E. Thus, the internal combustion engine E is contained in an engine compartment formed by the under case 14*b* and the upper engine cover 17. The mount case 14*a* and the under case 14*b* may be separately formed and may be joined together to form the lower engine case 14.

A drive shaft 18 is connected to the lower end of the crankshaft 9 and extends through the lower engine case 14. The drive shaft 18 is interlocked with a propeller shaft 20 by a forward/reverse change gear 19 consisting of a bevel gear mechanism and a clutch mechanism and contained in the gear case 16. The power of the internal combustion engine E is transmitted from the crankshaft 9, through the drive shaft 18, the forward/reverse change gear 19 and the propeller shaft 20 to a propeller 21 to drive the propeller 21 for rotation.

A swivel case 24 is supported for turning in a vertical plane by a tilt shaft 23 on a transom clamp 22 for detachably mounting the outboard engine 1 on the ship. A swivel shaft 25 is fitted in a tubular support part 24*a* of the swivel case 24 so as to be turnable. The swivel shaft 25 has an upper end connected to the lower engine case 14 by a rubber mount, and a lower end connected to the extension case 15 by a rubber mount. A steering handle, not shown, connected to the swivel shaft 25 is turned in a horizontal plane to turn the outboard engine 1 on the swivel shaft 25 in a horizontal plane for steering.

Referring to FIGS. 1 and 2, a valve chamber 30 is formed by the cylinder head 4 and the cylinder head cover 5. Arranged in the valve chamber 30 are a valve train V for opening and closing intake valves 43 and exhaust valves 44 (FIG. 4), and decompression mechanisms D1 to D3 for relieving compression pressures in the cylinders C1 to C3 during compression strokes at the start of the internal combustion engine E. The valve train V includes a camshaft 31. The cylinder head 4 and the head cover 5 are valve chamber forming members for forming the valve chamber 30.

Figure 4:
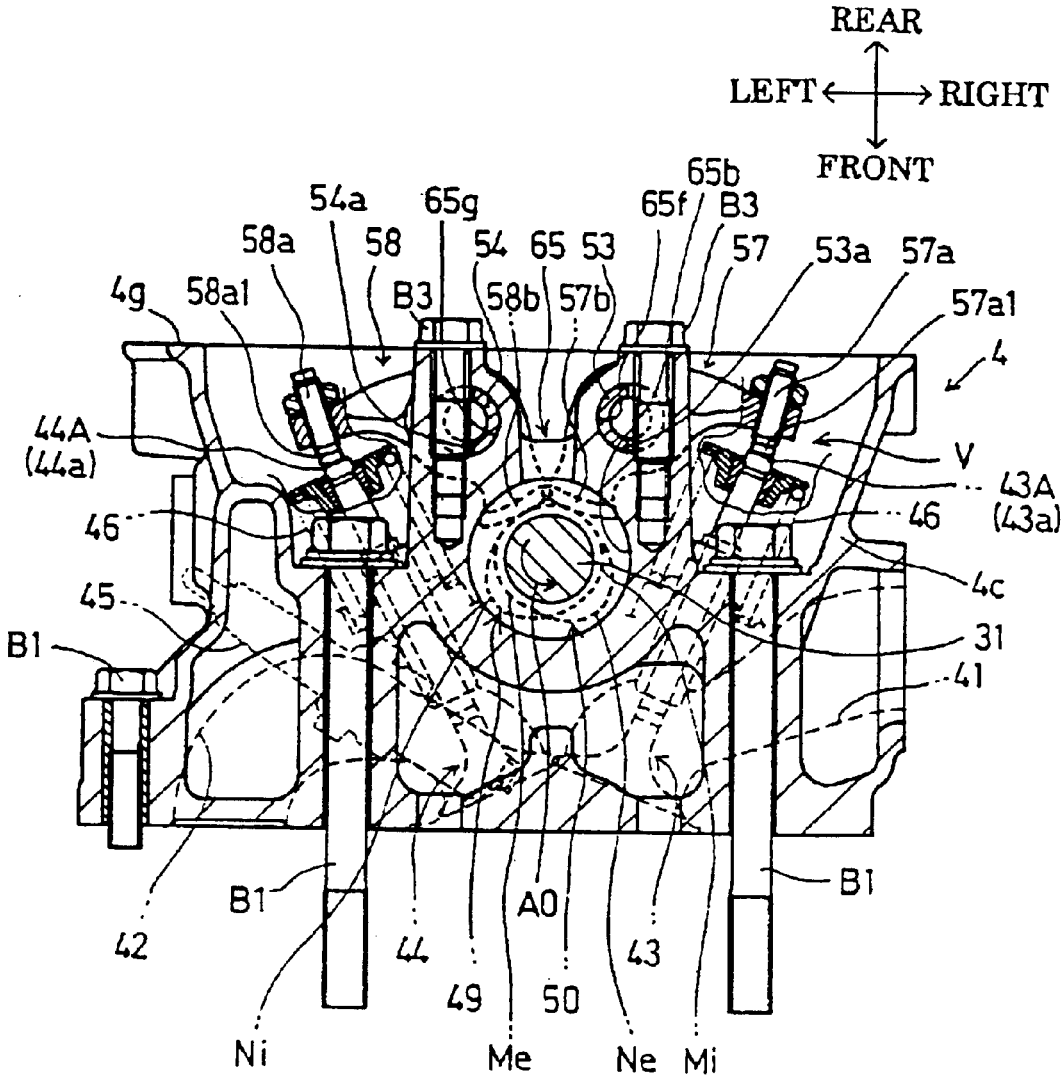
FIG. 4 is a sectional view generally taken on the line IVa—IVa in FIG. 3, including a sectional view of a part around the free end of an exhaust rocker arm near an exhaust valve taken on the line IVb—IVb in FIG. 3, and a sectional view of a part around the free end of an exhaust rocker arm near an exhaust valve taken on the IVc—IVc in FIG. 3.
Figure 6:
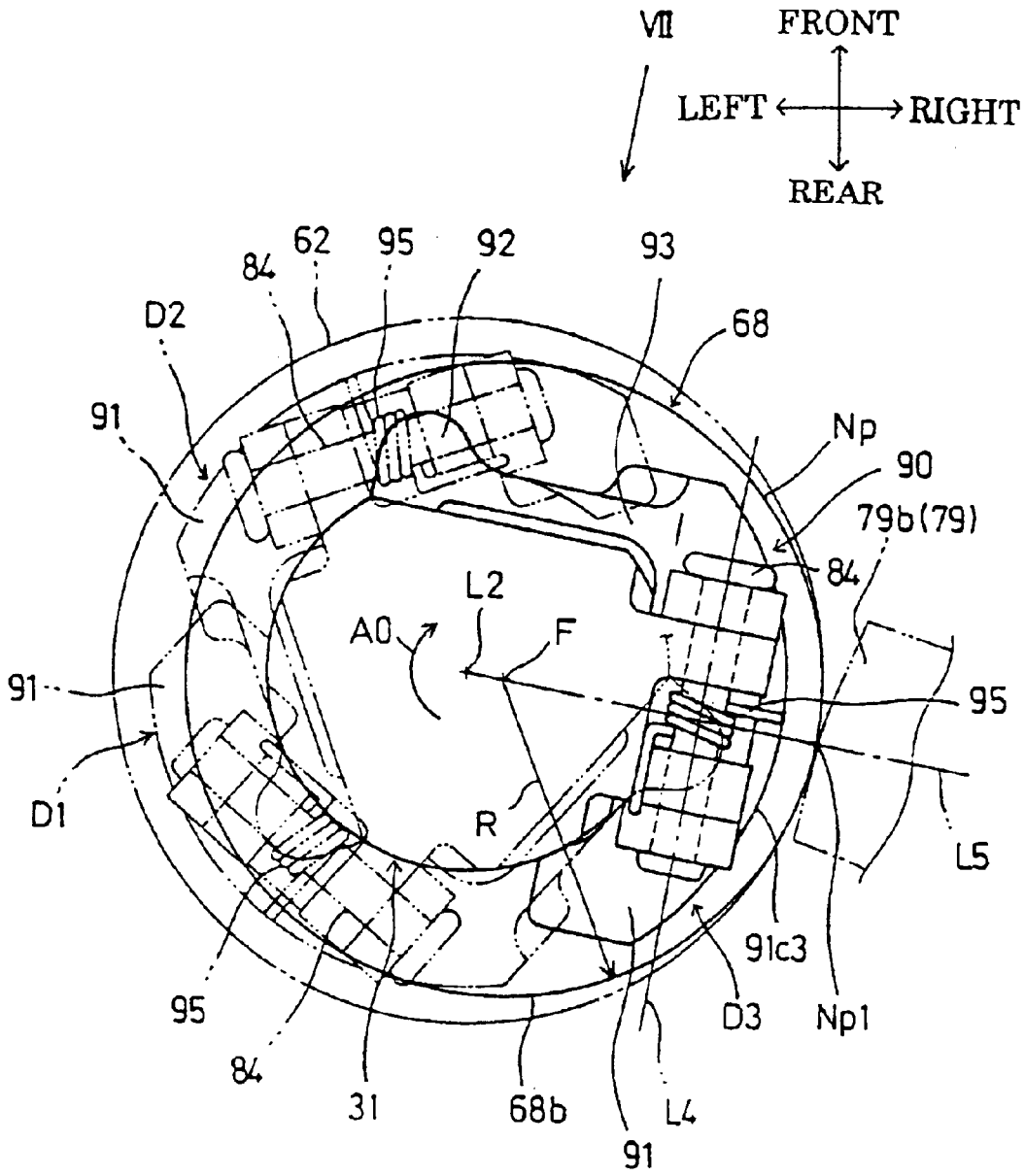
FIG. 6 is a sectional view taken on the line VI—VI in FIG. 3, of assistance in explaining the arrangement of a decompression mechanism with respect to the rotating direction of the camshaft.

The camshaft 31 is supported for rotation on the cylinder head 4 in the valve chamber 30 with its axis L2 extended parallel to the axis L1 (FIG. 1) of the crankshaft 9. As shown in FIG. 2, the camshaft 31 penetrates the upper wall 4*a* of the cylinder head 4, i.e., an end wall at one end of the cylinder head 4 with respect to the axial direction A1. An oil seal 32 seals the gap between the camshaft 31 and the upper wall 4*a*. A pulse generator 33 for detecting the angular position of the camshaft 31, and a camshaft pulley 34 are mounted and arranged on an upper end part 31*a* of the camshaft 31 projecting upward from the valve chamber 30 in that order upward. The power of the crankshaft 9 is transmitted to the camshaft 31 by a power transmitting mechanism including the crankshaft pulley 11, the camshaft pulley 34 and a timing belt 35 extended between the crankshaft pulley 11 and the camshaft pulley 34 to drive the camshaft 31 at half the rotating speed of the crankshaft 9 in a direction A0 (FIGS. 4 and 6).

The pulse generator 33 includes one magnetic member 33*a* (FIG. 3) attached to the inner surface of the camshaft pulley 34, and a coil unit 33*b* attached to the upper wall 4*a* and surrounding the upper end part 31*a*. The coil unit 33*b* includes three pickup coils arranged at equal circumferential intervals. The magnetic member 33*a* passes the three pickup coils successively as the camshaft 31 rotates. Ignition for the cylinders C1 to C3 is timed on the basis of the output signals of the pickup coils.

A trochoid oil pump 37 has a pump body 37*b* and a pump cover 37*c*. The oil pump 37 is fastened to the lower wall 4*b*, i.e., the other end wall with respect to the axial direction A1, of the cylinder head 4 with a plurality bolts B2 passed through the pump body 37*b* and the pump cover 37*c*. The oil pump 37 has a shaft 37*a* connected to the lower end of the camshaft 31 by a connecting member 36. The camshaft 31 drives the shaft 37*a*. The oil pump 37 sucks lubricating oil contained in an oil pan 38 (FIG. 1) attached to the lower end of the lower engine case 14 through a suction pipe 39*b* provided with an oil strainer 39*a*, and suction passages formed in the cylinder block 2 and the cylinder head 4. The lubricating oil discharged from the oil pump 37 flows through discharge passages formed in the cylinder head 4 and the cylinder block 2, and an oil filter into a main oil gallery. The lubricating oil is distributed from the main oil gallery to the main bearings and to moving parts to be lubricated.

The internal combustion engine E will be described with reference FIGS. 2 and 3.

The first cylinder C1, the second cylinder C2 and the third cylinder C3 are arranged in a row along the axial direction A1. The second cylinder C2 is the middle cylinder. The first cylinder C1 and the third cylinder C3 are on the opposite sides, respectively, of the second cylinder C2.

Referring to FIG. 4, the cylinder head 4 is provided with a combustion chamber 40, an intake port 41 through which intake gas supplied from an intake device, not shown, attached to the right wall 4*c* of the cylinder head 4, i.e., a side wall on the intake side, is supplied into the combustion chamber 40, and an exhaust port through which the combustion gas is discharged from the combustion chamber 40 into an exhaust passage, not shown, for each of the cylinders C1 to C3. The intake device includes carburetors, i.e., fuel supply devices for producing air-fuel mixture by introducing fuel into intake air, respectively for the cylinders C1 to C3, and an intake manifold for distributing the air-fuel mixture to the intake ports 41.

An intake valve 43 for opening and closing the intake port and an exhaust valve 44 for opening and closing the exhaust port are slidably inserted in valve guides on the cylinder head 4 for each of the cylinders C1 to C3. Valve springs 46 force by their resilience the intake valve 43 and the exhaust valve 44 for each of the cylinders C1 to C3 back up onto their valve seats.

In the suction stroke, in which the intake valve 43 is opened and the piston 7 moves toward the bottom dead center, the air-fuel mixture is sucked through the intake port 41 into the combustion chamber 40. In the compression stroke, the air-fuel mixture is compressed by the piston 7 moving toward the top dead center, ignited by an ignition plug 45 attached to a part of the cylinder head 4 on the exhaust side above the exhaust valve 44 and burns. In the expansion stroke, the piston 7 is moved toward the bottom dead center by the pressure of a combustion gas, driving the crankshaft 9 through the connecting rod 8 for rotation. In the exhaust stroke, in which the piston moves toward the top dead center, the combustion gas is discharged as an exhaust gas from the combustion chamber 40 through the exhaust port 42 into the exhaust passage. The exhaust gas is discharged through an exhaust pipe from the outboard engine 1.

The valve train V includes the camshaft 31 extended in the valve chamber across the cylinders C1 to C3 and provided with intake cams 47, 49 and 51, and exhaust cams 48, 50 and 52 for the cylinders C1 to C3, a pair of rocker-arm shafts supported on the cylinder head 4 nearer to the head cover 5 than the camshaft 31, i.e., an intake rocker-arm shaft 53 and an exhaust rocker-arm shaft 54, intake rocker arms 55, 57 and 59, and exhaust rocker arms 56, 58 and 60 supported for rocking motion on the intake rocker-arm shaft 53 and the exhaust rocker-arm shaft 54, respectively (FIG. 3). The intake rocker arms 55, 57 and 59, and the exhaust rocker arms 56, 58 and 60 are cam followers driven by the intake cams 47, 49 and 51, and the exhaust cams 48, 50 and 52, respectively. Those component parts of the valve train V are arranged in the valve chamber 30.

The camshaft 31 has journals 61, 62 and 63 supported by bearings 64, 65 and 66, respectively, in the valve chamber 30. The journals 61 to 63 of the camshaft 31 are a first end journal 61 formed on the camshaft 31 at a position in the upper end part of the valve chamber 30 near the upper end part 31*a*, a second end journal 63 formed on the lower end part 31*b* of the camshaft 31 coinciding with the connecting member 36 with respect to the axial direction A1 in the lower end part of the valve chamber 30, and a middle journal 62 formed in a middle part of the camshaft 31 between the first end journal 61 and the second end journal 63. The diameter of the middle journal 62 is greater than those of the end journals 61 and 63. The bearings 64 to 66 are a first end bearing 64 formed integrally with the upper wall 4*a* to support the first end journal 61, a second end bearing 66 formed in the lower wall 4*b* to support the second end journal 63, and a middle bearing 65 positioned between the end bearings 64 and 66 to support the middle journal 62.

The first end bearing 64 and the middle bearing 65 are formed integrally with the cylinder head 4 and protrude toward the head cover 5. The second end bearing 66 coinciding with the connecting member 36 with respect to the axial direction A1 is a tubular projection 37*d* formed integrally with the pump body 37*b* and projecting through a through hole 4*e* formed in the lower wall 4*b* into the valve chamber 30. The bearings 64 to 66 are provided with bearing holes 64*b*, 65*b* and 66*b* for slidably receiving the journals 61 to 63 respectively.

The camshaft 31 is integrally provided with a flange 67 having a contact surface 67*a* in contact with an end surface 64*a*, facing the valve chamber, of the first end bearing 64, and a plate-shaped pump cam 68, i.e., an eccentric cam, having a contact surface 68*a* in contact with an end surface 66*a*, facing the valve chamber, of the second end bearing 66. The pump cam 68 is adjacent to the second end bearing 66, i.e., a specific bearing. The flange 67 and the pump cam 68 are in contact with the end bearings 64 and 66, respectively to serve as thrust bearing members for restraining the camshaft 31 from movement in the axial directions A1. More concretely, the flange 67 in contact with the end surface 64*a* restrains the camshaft 31 from upward movement, and the pump cam 68 in contact with the end surface 66*a* restrains the camshaft 31 from downward movement.

The camshaft 31 is integrally provided with the intake cam 47 and the exhaust cam 48 for the first cylinder C1, i.e., the upper end cylinder, the intake cam 51 and the exhaust cam 52 for the third cylinder C3, i.e., the lower end cylinder, and intake cam 49 and the exhaust cam 50 for the second cylinder C2 in parts thereof between the flange 67 and the pump cam 68.

As best shown in FIG. 4, the intake cams 47, 49 and 51, and the exhaust cams 48, 50 and 52 have round base parts Mi and Me for closing the corresponding intake valves 43 and exhaust valves 44 pushed in the closing direction by the valve springs 46, respectively, and cam lobes Ni and Ne for timing the opening and closing operations and lifts of the corresponding intake valves 43 and exhaust valves 44, respectively.

In the cylinders C1 to C3, the exhaust cams 48, 50 and 52 are below the intake cams 47, 49 and 51, respectively. Decompression mechanisms D1 to D3 are disposed below the exhaust cams 48, 50 and 52, respectively. The decompression mechanisms D1 to D3 opens and close the exhaust valves 44 during the compression stroke in starting the internal combustion engine E by means of the recoil starter 13. The decompression mechanisms D1 to D3 open the exhaust valves 44 by a small decompression lift to enable the air-fuel mixture compressed in the cylinders C1 to C3 to escape through the slightly opened exhaust ports 42 to relieve compression pressure for a decompressing operation.

The intake cams 47 and 49, the exhaust cams 48 and 50, and the decompression mechanisms D1 and D2 respectively associated with the first cylinder C1 and the second cylinder C2 are arranged between the middle journal 62 and the first end journal 61. The intake cam 51, the exhaust cam 52 and the decompression mechanism D3 associated with the third cylinder C3 are arranged between the middle journal 62 and the second end journal 63. Views of parts, around the decompression mechanisms D1 to D3, of the camshaft shown in FIGS. 1 to 3 are those taken from an angular direction different from an angular direction from which the rest of the parts of the camshaft 31 are viewed. Actually, the decompression mechanisms D1 to D3 are arranged at equal angular intervals with respect to the rotating direction A0 of the camshaft 31.

A cylindrical part 31*c* of the camshaft 31 extends between the intake cam 49 for the second cylinder C2 nearer to the first cylinder C1 than the exhaust cam 50 and the decompression mechanism D2, and the decompression mechanism D1 associated with the first cylinder C1, is nearer to the second cylinder C2 than the intake cam 47 and the exhaust cam 48 for the first cylinder, and is not supported by any bearing and not provided with any journal.

The intake cam 49 among the intake cam 49, the exhaust cam 50 and the decompression mechanism D2 associated with the second cylinder C2 is adjacent to the decompression mechanism D1 among the intake cam 47, the exhaust cam 48 and the decompression mechanism D1 associated with the first cylinder C1. Therefore, a part, adjacent to the decompression mechanism D1 associated with the first cylinder C1 with respect to the axial direction A1, of the camshaft 31 is the intake cam 49 for the second cylinder C2. Thus, a centrifugal weight 91 included in the decompression mechanism D1 and the intake cam 49 are adjacent to each other.

The middle journal 62 is formed in a cylindrical part 31*d*, extending between the decompression mechanism D2 nearer to the third cylinder C3 than the intake cam 49 and the exhaust cam 50 for the second cylinder, and the intake cam 51 nearer to the second cylinder C2 than the exhaust cam 52 and the decompression mechanism D3 associated with the third cylinder C3, of the camshaft 31. The middle journal 62 is supported by the middle bearing 65.

The intake cam 51, the exhaust cam 52 and the decompression mechanism D3 associated with the third cylinder C3 are arranged between the second end bearing 66 and the middle bearing 65 adjacent to the second bearing 66 with respect to the axial direction A1. The decompression mechanism D3 among the intake cam 51, the exhaust cam 52 and the decompression mechanism D3 is disposed near the pump cam 68 with respect to the axial direction A1 opposite the second bearing 66 with respect to the pump cam 68.

The intake cam 49 for the second cylinder C2 is at a short distance toward the intake cam 47 for the first cylinder C1 from a position dividing the interval with respect to the axial direction A1 between the intake cams 47 and 51 respectively for the first cylinder C1 and the third cylinder C3 into two equal parts. Similarly, the exhaust cam 50 for the second cylinder C2 is at a short distance toward the exhaust cam 48 for the first cylinder C1 from a position dividing the interval with respect to the axial direction A1 between the exhaust cams 48 and 52 respectively for the first cylinder C1 and the third cylinder C3 into two equal parts. The decompression mechanism D2 for the second cylinder C2 is disposed in a space extending in the axial direction A1 and formed by disposing the intake cam 49 and the exhaust cam 50 of the second cylinder C2 nearer to the first cylinder C1.

The camshaft 31 is mounted on the cylinder head 4 in the following manner. The camshaft 31 provided with the decompression mechanisms D1 to D3 is passed upward through the through hole 4*e* of a diameter greater than that of the middle journal 62, a through hole 69*a* of a diameter greater than that of the middle journal 62 formed in a shaft support 69, the bearing hole 65*b* of the middle bearing 65, and the bearing hole 64*b* of the first end bearing 64. Then, the oil pump 37 is joined to the lower wall 4*b* such that the contact surface 67*a* of the flange 67 is in contact with the first bearing 64 and the second end journal 63 is fitted in the bearing hole 66*b* of the second end bearing 66.

Referring to FIGS. 2 to 5, the rocker-arm shafts 53 and 54 are inserted in through holes 4*f* and 4*g* formed in the lower wall 4*b*. The rocker-arm shafts 53 and 54 are passed through a pair of through holes 69*f* (FIG. 3) and 69*g* (FIG. 5) formed in a rocker support 69 formed integrally with the cylinder head 4 at a position between the lower wall 4*b* and the middle bearing 65 so as to protrude toward the head cover 5. The rocker-arm shafts 53 and 54 are extended upward through the through holes 4*f* and 4*g* formed in the lower wall 4*b*, a pair of through holes 65*f* and 65*g* formed in the middle bearing 65 and a pair of through holes 64*f* and 64*g* formed in the first end bearing 64, respectively. As shown in FIG. 4, bolts B3 are screwed through cuts 53*a* and 54*a* formed in parts, in the middle bearing 65, of the rocker-arm shafts 53 and 54 in threaded holes formed in the middle bearing 65 to restrain the rocker-arm shaft 53 and 54 from rotation and to hold the same in place.

Referring to FIGS. 2 to 4, the intake rocker arms 55, 57 and 59 have ends provided with adjusting screws 55*a*, 57*a* and 59*a*, respectively. The tips of the adjusting screws 55*a*, 57*a* and 59*a* (only the tip 57*a*1 of the adjusting screw 57 is shown in FIG. 4) are in contact with the ends 43*a* of the valve stems of the intake valves 43 (the end 43*a* of the valve stem in contact with the tip 57*a*1 of the adjusting screw 57*a* attached to the intake rocker arm 57 is denoted by 43A for convenience' sake). The intake rocker arms 55, 57 and 59 have the other ends provided with slippers 55*b*, 57*b* and 59*b*, i.e., contact parts, in contact with the intake cams 47, 49 and 51, respectively. Fulcrums 55*c*, 57*c* and 59*c* provided with through holes are formed in middle parts, between the adjusting screws 55*a*, 57*a* and 59*a*, and the slippers 55*b*, 57*b* and 59*b*, of the intake rocker arms 55, 57 and 59, respectively. The intake rocker-arm shat 53 is extended through the through holes of the fulcrums 55*c*, 57*c* and 59*c*.

The exhaust rocker arms 56, 58 and 60 have ends provided with adjusting screws 56*a*, 58*a* and 60*a*, respectively. The tips of the adjusting screws 56*a*, 58*a* and 60*a* (only the tip 58*a*1 of the adjusting screw 58 is shown in FIG. 4) are in contact with the ends 44*a* of the valve stems of the exhaust valves 44 (the end 44*a* of the valve stem in contact with the tip 58*a*1 of the adjusting screw 58*a* attached to the exhaust rocker arm 58 is denoted by 44A for convenience' sake). The exhaust rocker arms 56, 58 and 60 have the other ends provided with slippers 56*b*, 58*b* and 60*b*, i.e., contact parts, in contact with the exhaust cams 48, 50 and 52, respectively. Fulcrums 56*c*, 58*c* and 60*c* provided with through holes are formed in middle parts, between the adjusting screws 56*a*, 58*a* and 60*a*, and the slippers 56*b*, 58*b* and 60*b*, of the exhaust rocker arms 56, 58 and 60, respectively. The exhaust rocker-arm shat 54 is extended through the through holes of the fulcrums 56*c*, 58*c* and 60*c*.

Positioning collars 70 and positioning springs 71 are mounted on the intake rocker-arm shaft 53 and the exhaust rocker-arm shaft 54 to position the intake rocker arms 55, 57 and 59, and the exhaust rocker arms 56, 58 and 60 respectively for the cylinders C1 to C3 with respect to the axial direction A1.

The intake rocker arm 57 and the exhaust rocker arm 58 for the second cylinder C2 are specific rocker arms. The tips of the adjusting screws 57*a* and 58*a* of the intake rocker arm 57 and the exhaust rocker arm 58 are offset toward the decompression mechanism D2, i.e., downward, with respect to the axial direction A1 relative to the corresponding slippers 57*b* and 58*b*. The tip of the adjusting screw 58*a* of the exhaust rocker arm 58 coincides with the decompression mechanism D2 with respect to the axial direction A1. The tip 57*a*1 of the adjusting screw 57*a* of the intake rocker arm 57, the end of 43A of the valve stem of the intake valve 43, and the exhaust cam 50 coincide with each other with respect to the axial direction A1. Consequently, a straight line connecting the slipper 57*b* and the tip of the adjusting screw 57*a* of the intake rocker arm 57 , and a straight line connecting the slipper 58*b* and the tip of the adjusting screw 58*a* of the exhaust rocker arm 58 extend obliquely relative to the intake rocker-arm shaft 53 and the exhaust rocker-arm shaft 54, respectively.

The exhaust cam 50 is a specific valve cam for operating the exhaust rocker arm 58 to operate the exhaust cam 44, operated by the decompression mechanism D2, for the second cylinder C2. The exhaust cam 50 does not coincide with and is positioned above the end 44A of the valve stem of the exhaust valve 44 for the second cylinder C2 with respect to the axial direction A1. The decompression mechanism D2 coincides with the end 44A of the valve stem of the exhaust valve 44 with respect to the axial direction A1. The second cylinder C2 is a specific cylinder.

The intake cams 47, 49 and 51 and the exhaust cams 48, 50 and 52 rotating together with the camshaft 31 rocks the intake rocker arms 55, 57 and 59 and the exhaust rocker arms 56, 58 and 60 to open and close the intake valves 43 and the exhaust valves 44 for the cylinders C1 to C3 at predetermined crank angles, respectively.

Referring to FIGS. 2 and 3, part of the lubricating oil sent into the main oil gallery flows through an annular oil passage K1 formed between a bolt hole formed in a top boss S1 formed in a part of the cylinder head 4 on the exhaust side and a head bolt B1 inserted in the bolt hole of the top boss S1, and an oil passage K2 formed in the cylinder head 4 into a small oil chamber K3 sealed by a cover 72. Then, the lubricating oil flows from the oil chamber K3 through oil passages K4 and K5 (FIG. 5) formed in the hollow rocker-arm shafts 53 and 54, and radial oil holes formed in the rocker-arm shafts 53 and 54 to the sliding parts of the intake rocker arms 55, 57 and 59, the exhaust rocker arms 56, 58 and 60, the intake rocker-arm shaft 53 and the exhaust rocker-arm shaft 54, flows through an oil passage K6 formed in the first end bearing 64 and opening into the bearing hole 64*b* to the sliding parts of the first end bearing 64 and the first end journal 61, flows through the oil passage K4, and holes formed in the intake rocker-arm shaft 53 and the middle bearing 65 to the sliding parts of the middle bearing 65 and the middle journal 62. A through hole 4*g* into which the lower ends of the oil passages K4 and K5 open is covered with the pump body 37*b* of the oil pump 37.

The lubricating oil flowed through the small holes and lubricated the sliding parts drips into the valve chamber 30, and lubricates the sliding parts of the intake cams 47, 49 and 51, the exhaust cams 48, 50 and 52, the intake rocker arms 55, 57 and 59, the exhaust rocker arms 56, 58 and 60, the sliding parts of the decompression mechanisms D1 to d3, and the sliding parts of the second end bearing 66 and the second end journal 63, and then collects on the bottom wall, formed by the lower wall 4*b* and the lower wall of the head cover 5, of the valve chamber 30. Then, the lubricating oil collected on the bottom wall flows through oil passages K7 and K8 (FIG. 2) formed in the cylinder block 2, and an oil pipe 73 connected to the head cover 5 into an oil passage K9 formed in the lower engine case 14, and returns through a return pipe to the oil pan 38.

Figure 5:
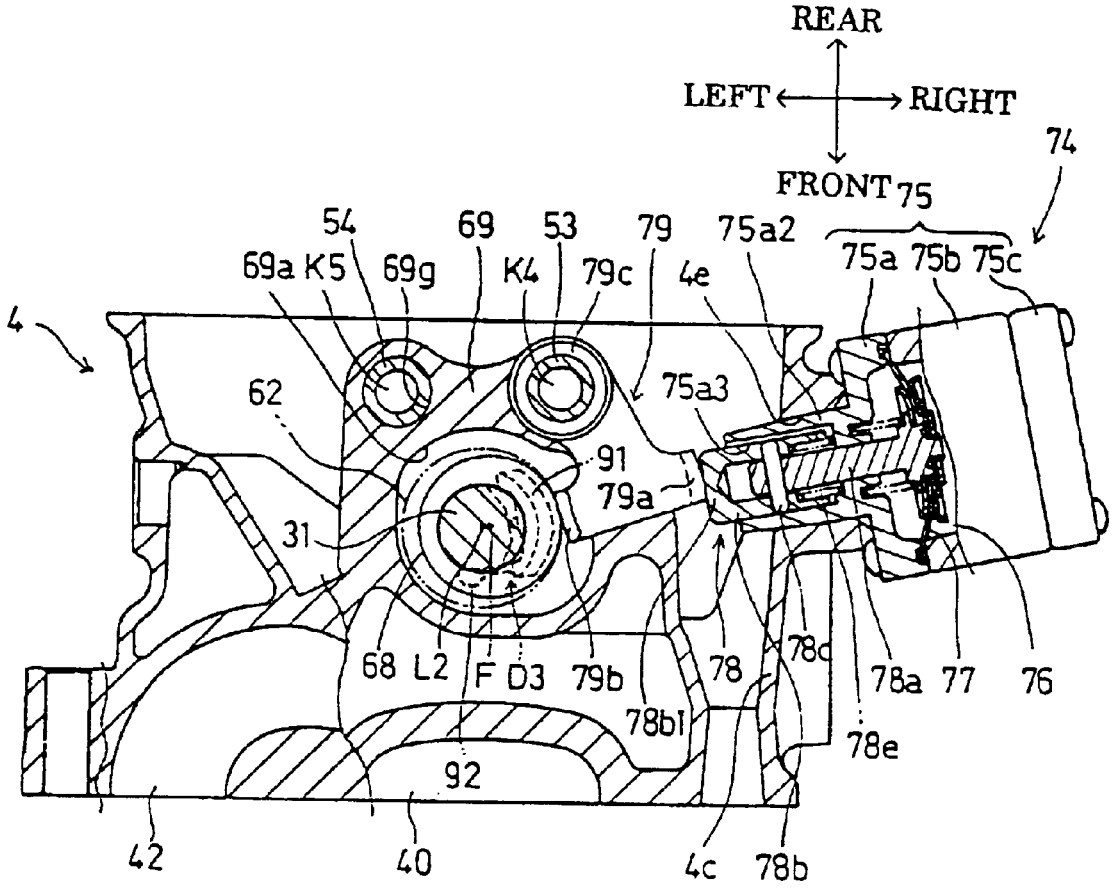
FIG. 5 is a fragmentary sectional view of a cylinder head and a fuel pump generally taken on the line Va—Va in FIG. 3 including a sectional view of a camshaft and a swing arm taken on the line Vb—Vb in FIG. 3.

Referring to FIGS. 2, 3 and 5, a fuel pump 74 for pressurizing the fuel to the carburetor is a displacement pump driven for a pumping action by the pump cam 68. The fuel pump 74 is fastened to a pump mount formed on the outer surface of the right wall 4*c* of the cylinder head 4 with bolts B4.

The pump cam 68 formed in the camshaft 31 is adjacent to the upper side of the second end journal 63 in the bottom part of the valve chamber 30. The decompression mechanism D3 is disposed above and close to the pump cam 68, and the exhaust cam 52 is above the decompression mechanism D3. As shown in FIGS. 5 and 6, the pump cam 68 is a circular eccentric cam of a radius R having its center F displaced by a predetermined eccentricity toward the intake side from the axis L2 of rotation. The circumference of the pump cam 68 serves as a cam surface 68*b*. A section, in which the distance between the axis L2 of rotation and the cam surface 68*b* is greater than the radius R, of the cam surface 68*b* defines a cam lobe Np.

Referring to FIG. 5, the fuel pump 74 has a housing 75 defining a pump chamber 76, a diaphragm 77, and an actuating rod 78 connected to the diaphragm 77.

The housing 75 is formed by stacking up three members 75*a*, 75*b* and 75*c*. The member 75*a* nearest to the cylinder head 4 has a flange 75*a*1 (FIG. 3) fastened to the pump mount with bolts B4, and a tubular projection 75*a*2 projecting through a through hole 4*e* into the valve chamber 30.

The actuating rod 78 is formed by combining a first rod 78*a* connected to the diaphragm 77, and a second rod 78*b* provided with a bottomed hole for receiving the first rod 78*a*, and connected to the first rod 78*a* with a pin 78*c*. The second rod 78*b* is fitted slidably in a guide hole 75*a*3 formed in the tubular projection 75*a*2 so that its end part 78*b*1 projects from the inner open end of the tubular projection 75*a*2 into the valve chamber 30. A swing arm 79, i.e., a pump-operating member, is in contact with the tip of the end part 78*b*1. The actuating rod 78 is pushed by a pushing spring 78*e* toward the valve chamber 30 so that an end part 78*b*1 projects from the tubular projection 75*a*2, and the tip of the end part 78*b*1 is pressed against the swing arm 79.

The tubular projection 75*a*2 and the actuating rod 78 are disposed above the second end journal 63, the pump cam 68, and the lowermost head bolt B1*b* or the lowermost boss S2 provided with a bolt hole for receiving the head bolt B1*b*, or nearer to the exhaust cam 52 with respect to the axial direction A1. The tubular projection 75*a*2 and the actuating rod 78 are spaced a sufficient distance upward from the bottom wall of the valve chamber 30 on which the lubricating oil collects after lubricating the sliding parts of the valve train V and such placed in the valve chamber, and from the lower wall 4*b* toward the exhaust cam 52 in the axial direction A1.

The pump cam 68 drives the swing arm 79 to operate the actuating rod 78 of the fuel pump 74. The swing arm 79 has a fulcrum 79*c* provided with a through hole through which the intake rocker-arm shaft 53 is passed, a contact tip 79*b* in contact with the cam surface 68*b* of the pump cam 68, and a pushing tip 79*a* in contact with the tip of the end part 78*b*1 of the actuating rod 78.

The pump cam 68 that rotates together with the camshaft 31 drives the swing arm 79 to drive the actuating rod 78 for reciprocation. Consequently, the diaphragm 77 is flexed to increase and decrease the volume of the pump chamber 76. The fuel is sucked through a fuel pipe and a suction check valve from the fuel tank into the pump chamber 76 when the volume of the pump chamber 76 is increased. The fuel is forced to flow through the discharge check valve and a fuel pipe from the pump chamber 76 into the carburetor when the volume of the pump chamber 76 is decreased.

The pushing tip 79*a* of the swing arm 79 is in contact with the tip of the end part 78*b*1 of the actuating rod 78 at a position nearer to the decompression mechanism D3 than the contact tip 79*b* with respect to the axial direction A1. More concretely, the pushing tip 79*a* is at a level above those of the pump cam 68 and the contact tip 79*b* and coincides with the axis 14 of swing motion of the decompression mechanism D3 or the shaft support 69 with respect to the axial direction A1. Thus, the swing arm 79 inclines upward from the contact tip 79*b* toward the pushing tip 79*a* with respect to the axial direction A1 and extends over the head bolt B1*b* and the boss S2 formed in the cylinder head 4 so that the swing arm 79 may not interfere with the lowermost head bolt B1*b* coinciding with the pump cam 68 with respect to the axial direction A1 and the boss S2.

The decompression mechanisms D1 to D3 will be described with reference to FIGS. 2, 3, and 6 to 10.

The decompression mechanisms D1 to D3 associated with the cylinders C1 to C3 are identical in construction. As shown in FIG. 6, the decompression mechanisms D1 to D3 are arranged with their decompression cams 92 spaced in the rotating direction A0 of the camshaft 31 at phase differences corresponding to a cam angle of 120°, which corresponds to a crank angle of 240°. Referring to FIGS. 2 and 3, the decompression mechanisms D1 to D3 are disposed on three parts 80, extending downward from the exhaust cams 48, 50 and 52 in contact with the slippers 56*b*, 58*b* and 60*b* of the exhaust rocker arms 56, 58 and 60, of the camshaft 31, respectively.

Description will be made mainly of the decompression mechanism D3 with reference to FIGS. 7 to 10. Reference characters denoting the components of the decompression mechanisms D1 and D2 corresponding to the components of the decompression mechanism D3 mentioned in the following description will be indicated in parentheses.

A first cut part 81 having a flat support surface 81*a* is formed in the part 80 extending downward from the lower end 52*a* of the exhaust cam 52 (48, 50). The support surface 81*a* is included in a plane P1 parallel to the axis L2 of rotation and perpendicular to an axis L4 of swing motion. A second cut part 82 having a flat stopper surface 82*a* is formed so as to extend downward from the lower end of the first cut part 81. The stopper surface 82*a* is included in a plane P2 parallel to the axis L2 of rotation and perpendicular to the plane P1.

Figure 7A:
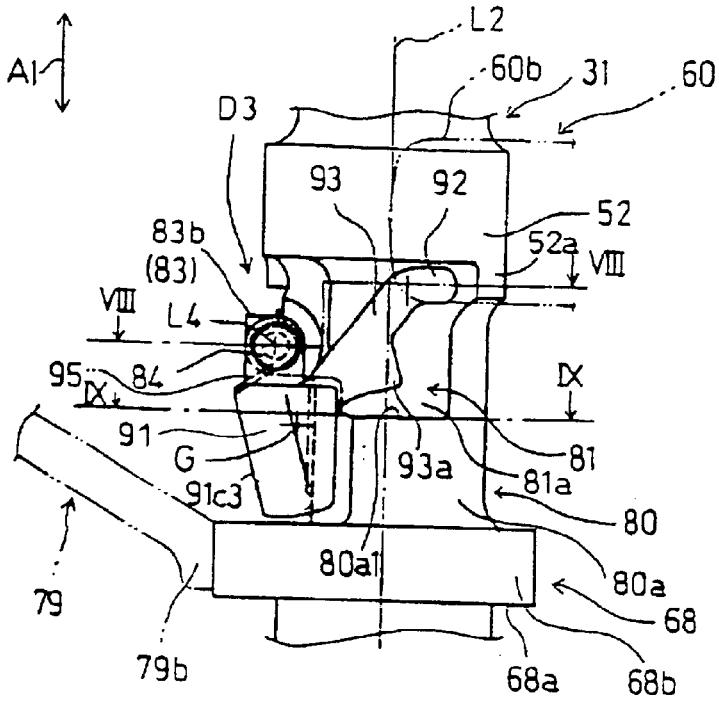
FIG. 7A is a fragmentary side elevation taken in the direction of the arrow VII in FIG. 6, in which the decompression mechanism is in an operative state.
Figure 8:
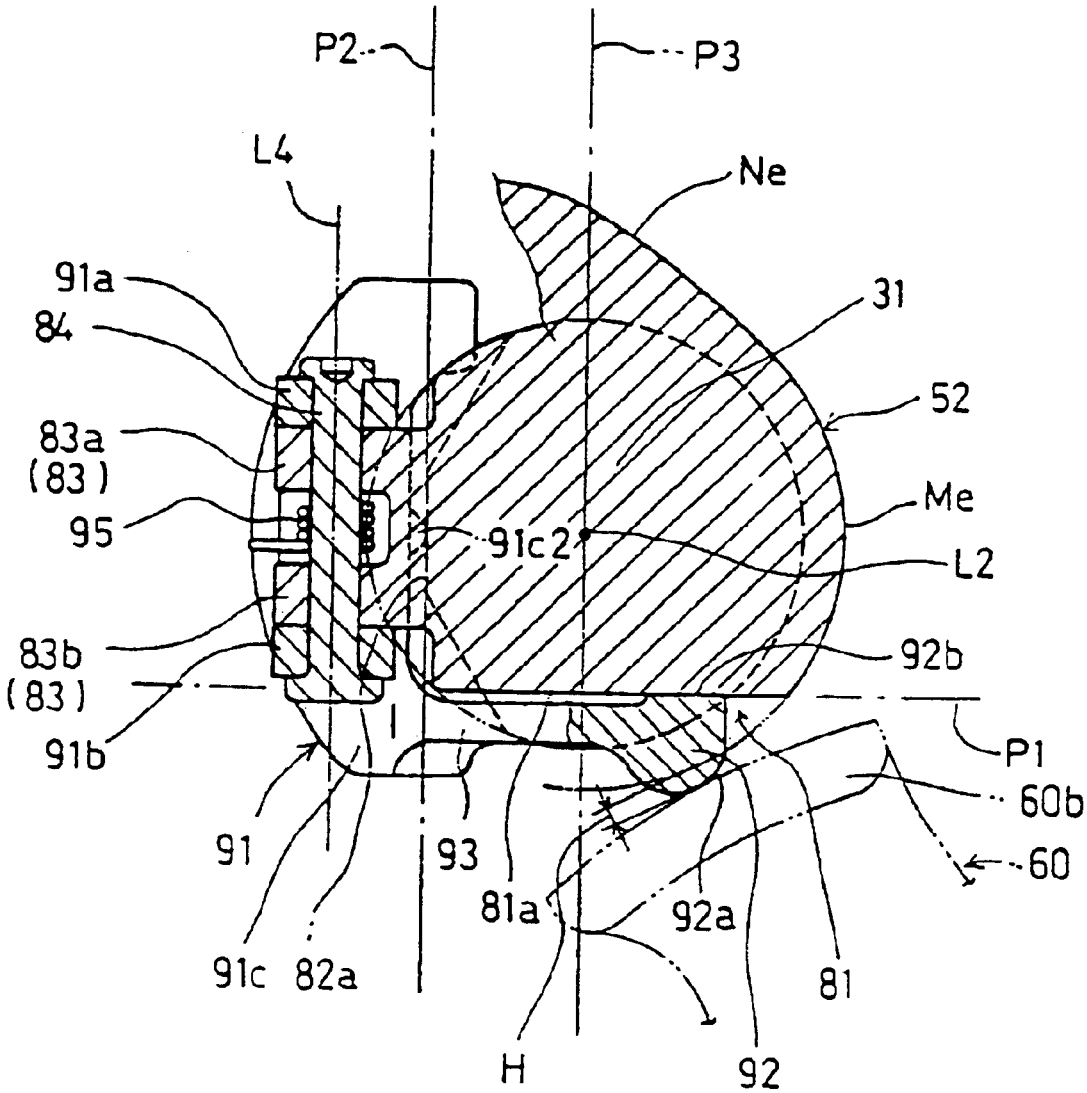
FIG. 8 is a cross-sectional view taken on the line VIII—VIII in FIG. 7A.
Figure 9:
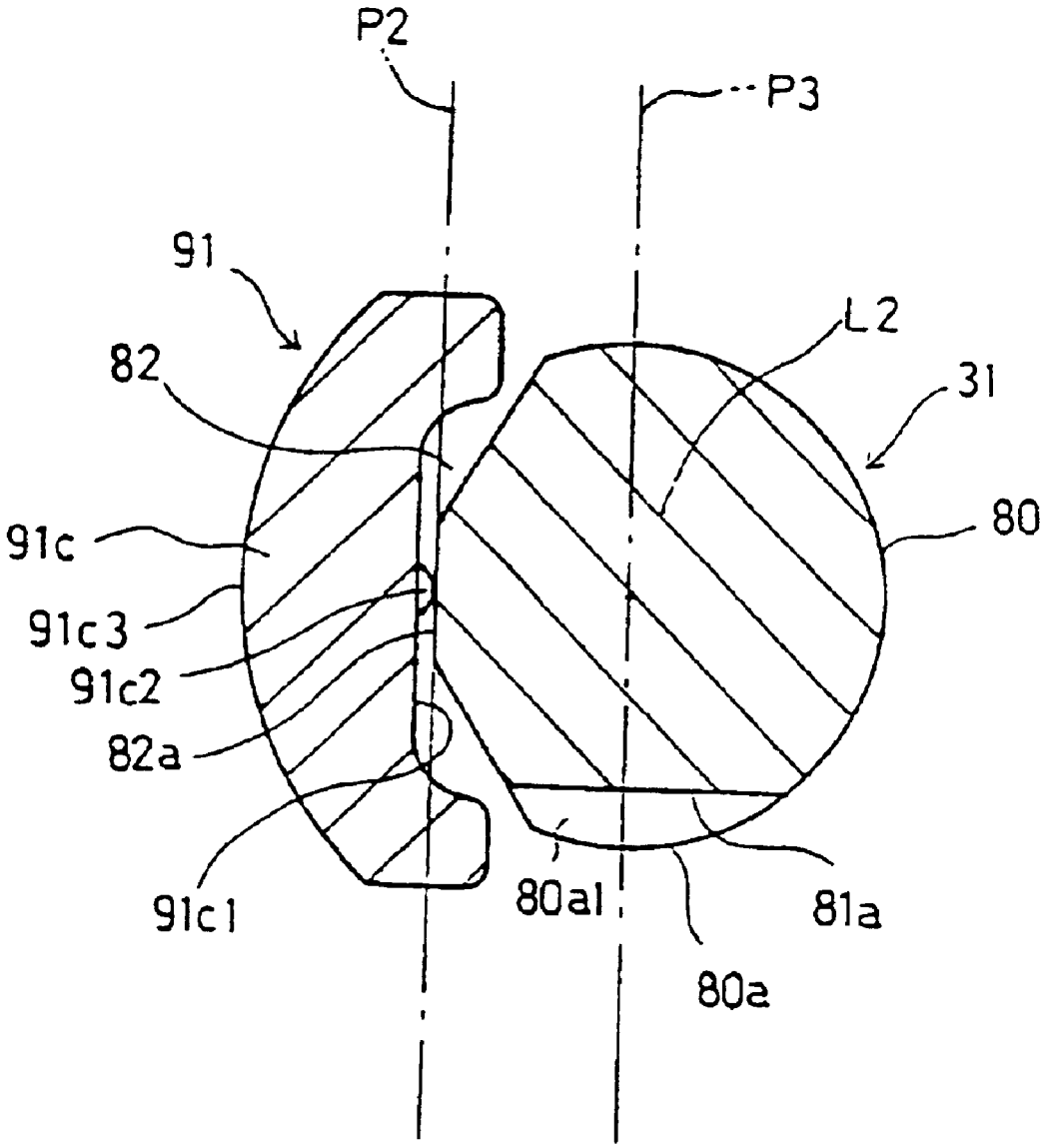
FIG. 9 is a cross-sectional view taken on the line IX—IX in FIG. 7A.

As shown in FIGS. 7A and 8, a support part 83 having a pair of projections 83*a* and 83*b* is formed integrally with the part 80 of the camshaft 31 above the second cut part 82. The pair of projections 83*a* and 83*b* project radially outward in parallel to the plane P1. A cylindrical pin 84 for supporting a centrifugal weight 91 for swing motion on the camshaft 31 is fitted in holes formed in the projections 83*a* and 83*b*.

Referring to FIGS. 10A to 10D, the decompression mechanism D3 includes a decompression member 90 of a metal formed by injection molding, and a return spring 95, i.e., a torsion coil spring. The decompression member 90 has the centrifugal weight 91 supported for swing motion on the support part 83 by the pin 84, a decompression cam 92 that turns together with the centrifugal weight 91 and comes into contact with the slipper 60*b* (56*b*, 58*b*) to open the exhaust valve 44 at the start of the internal combustion engine E, and a plate-shaped arm 93 connecting the centrifugal weight 91 and the decompression cam 92.

The return spring 95 is disposed between the pair of projections 83*a* and 83*b*. The return spring 95 has a resilience capable of applying the moment of a force high enough to hold the centrifugal weight 91 at its operative position shown in FIG. 7A until the engine speed increases to a predetermined engine speed at the start of the internal combustion engine E.

The centrifugal weight 91 has a weight body 91*c*, and a pair of knuckles 91*a* and 91*b* projecting from the weight body 91*c*. The knuckles 91*a* and 91*b* are adjacent to the upper side of the projection 83*a* and the lower side of the projection 83*b*, respectively, with respect to a direction parallel to the axis L4 of swing motion. The pin 84 is fitted in holes formed in the knuckles 91*a* and 91*b* so that the knuckles 91*a* and 91*b* are able to turn on the pin 84.

Figure 10A:
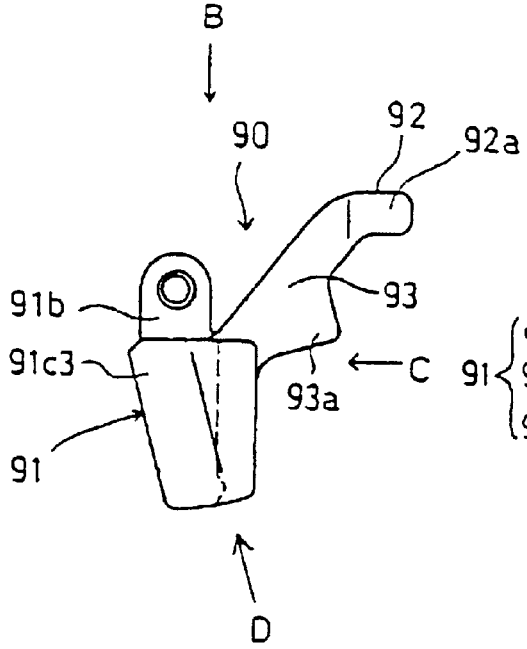
FIG. 10A is a side elevation of a decompressing member included in the decompression mechanism.
Figure 10B:
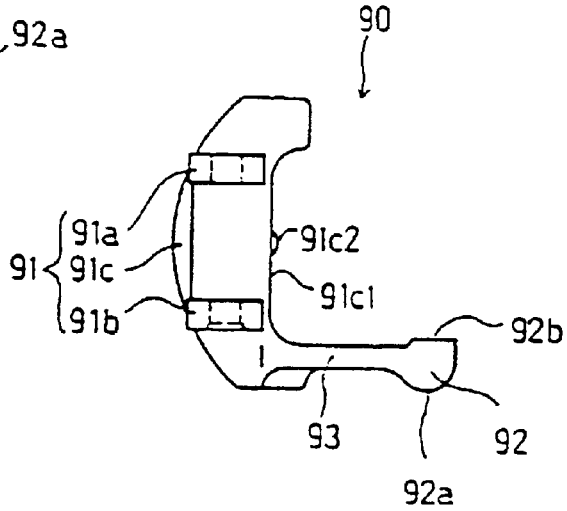
FIG. 10B is a view taken in the direction of the arrow B in FIG. 10A.
Figure 10C:
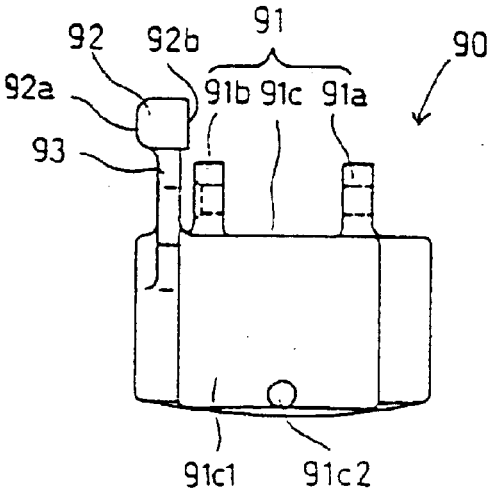
FIG. 10C is a view taken in the direction of the arrow C in FIG. 10A.
Figure 10D:
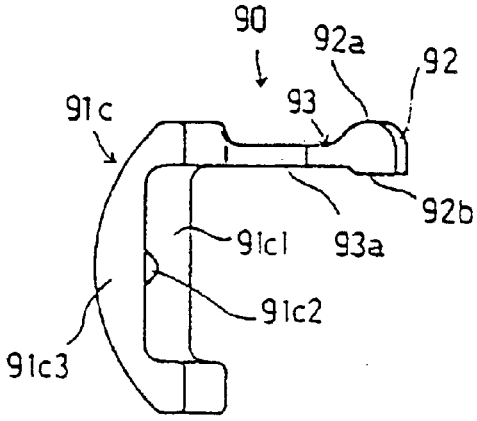
FIG. 10D is a view taken in the direction of the arrow D in FIG. 10A.

The weight body 91*c* has a flat surface 91*c*1 facing the camshaft 31 and provided with a contact protrusion 91*c*2. The weight body 91*c* has an outer surface 91*c*3 facing radially outward. As best shown in FIG. 10D, the outer surface 91*c*3 has a shape substantially resembling the shape of a part of the surface of a circular cylinder. The contact protrusion 91*c*2 rests on the stopper surface 82*a* of the second cut part 82 to set the centrifugal weight 91 (or the decompression member 90) at an operative position. The arm 93 has a lower surface provided with a contact protrusion 93*a*. The contact protrusion 93*a* rests on a stopper surface formed in a step 80*a* to set the centrifugal weight 91 (or the decompression member 90) at the radially outermost position to make the decompression mechanism D3 inoperative.

The decompression cam 92 formed at the free end of the arm 93 has a cam surface protruding from one side of the arm 93 in a direction parallel to the axis L4 of swing motion, and a contact surface 92*b* on the other side of the arm 93 in contact with the support surface 81*a*. The contact surface 92*b* slides along the support surface 81*a* when the centrifugal weight 91 turns on the pin 84. The decompression cam 92 projects from the round base part Me of the exhaust cam 52 (48, 50) in a predetermined height H (FIG. 8) when the decompression member 90 is at the operative position. A decompression lift by which the exhaust valve 44 is lifted for decompression is dependent on the height H.

Figure 7B:
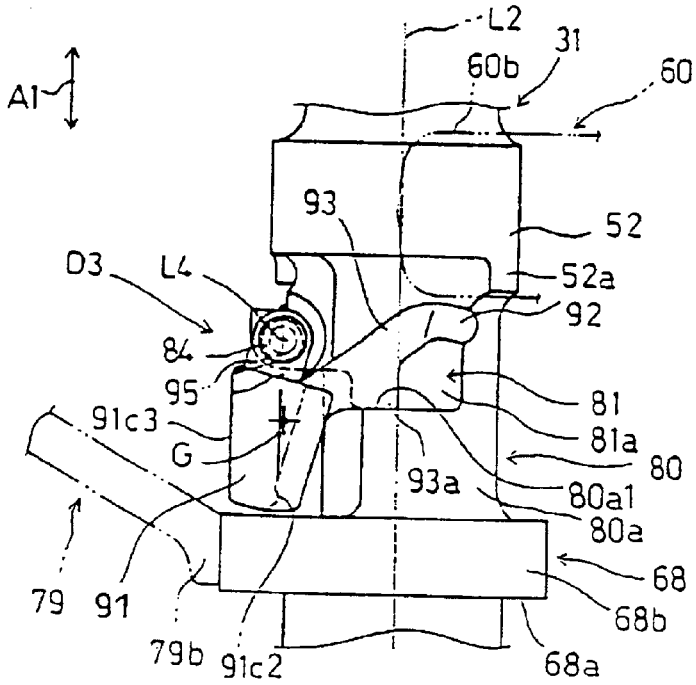
FIG. 7B is a fragmentary side elevation taken in the direction of the arrow VII in FIG. 6, in which the decompression mechanism is in an inoperative state.

The operation of the decompression mechanism D3 (D1, D2) will be described. Referring to FIGS. 7A and 7B, the center G of gravity of the decompression member 90 is nearer to a plane P3 including the axis L2 of rotation and parallel to the plane P2 than the axis L4 of swing motion while the internal combustion E is stopped and the camshaft 31 is not rotating. In this state, the weight of the decompression member 90 produces a clockwise moment of force about the axis L4 of swing motion. However, counterclockwise moment of force produced by the resilience of the return spring 95 exceeds the clockwise moment of force and holds the contact protrusion 91*c*2 (FIG. 9) of the centrifugal weight 91 in contact with the stopper surface 82*a* to keep the decompression member 90 at the operative position.

The starter knob 13*a* (FIG. 1) connected to a rope wound around a reel included in the recoil starter 13 is pulled to start the internal combustion engine E and thereby the crankshaft 9 is rotated. Since the engine speed is not higher than the predetermined engine speed at this stage, the decompression member 90 remains at the operative position. Consequently, the decompression cam 92 projecting radially outward from the round base part Me of the exhaust cam 52 (43, 50) comes into contact with the slipper 60*b* (56*b*, 58*b*) of the exhaust rocker arm 60 (56, 58 )to lift up the exhaust valve 44 by the decompression lift while the piston 7 in the cylinder C3 (C1, C2)is in the compression stroke. Thus, the air-fuel mixture compressed in the cylinder C3 (C1, C2) is discharged through the exhaust port 42 to reduce the compression pressure in the cylinder C3 (C1, C2). Consequently, the piston 7 is able to move easily past the top dead center and hence operating force necessary for operating the recoil starter 13 is reduced.

After the engine speed increases beyond the predetermined engine speed, the moment of force produced by centrifugal force acting on the decompression member 90 exceeds the moment of force produced by the resilience of the return spring 95. When the slipper 60*b* (56*b*, 58*b*) is not in contact with the decompression cam 92, the decompression member 90 starts being turned radially outward by the moment of force produced by the centrifugal force, and the arm 93 slides along the support surface 81*a*. The decompression member 90 is thus turned until the contact protrusion 93*a* of the arm 93 comes into contact with the stopper surface 80*a*1 and, finally, the decompression member 90 is held at the inoperative position as shown in FIG. 7B.

When the decompression member 90 is held at the inoperative position, the decompression cam 92 is moved from a position on the first cut part 81 coinciding with the exhaust cam 52 (48, 50) with respect to the axial direction A1 in the axial direction A1 and is separated from the slipper 60*b* (56*b*, 58*b*). Consequently, the decompression mechanism D3 (D1, D2) becomes inoperative, and the slipper 60*b* (56*b*, 58*b*) is in contact with the round base part Me of the exhaust cam 52 (48, 50) to keep the exhaust valve 44 closed while the piston 7 in the cylinder C3 (C1, C2) is in the compression stroke, so that the air-fuel mixture is compressed at a normal compression pressure. Then, the engine speed increases gradually and the operating mode of the internal combustion engine E changes through a perfect-combustion mode to an idling mode.

Referring to FIGS. 2 and 3, the axes L4 of swing motion of the decompression mechanisms D1 and D3 for the first cylinder C1 and the third cylinder C3 are below the exhaust rocker arms 56 and 60, respectively, with respect to the axial direction A1, and the decompression mechanisms D1 and D3 are below the lower ends of the exhaust cams 48 and 52, respectively, with respect to the axial direction. On the other hand, the axis L4 of swing motion of the decompression mechanism D2 for the second cylinder C2 is in an axial range between the positions with respect to the axial direction A1 of th e slipper 58*b* and the adjusting screw 58*a* of the exhaust rocker arm 58. The end 44A of the exhaust valve 44 coincides with the centrifugal weight 91 of the decompression mechanism D2 with respect to the axial direction A1, and most part of the decompression mechanism D2, i.e., a part between the decompression cam 92 and a more than half part of the centrifugal weight 91, coincides with the exhaust rocker arm 58 with respect to the axial direction A1.

The pin 84, part of the arm 93 and part of the centrifugal weight 91 of the decompression mechanism D3 associated with the third cylinder C3 are received in the through hole 69*a* of the shaft support 69 and coincide with the shaft support 69 with respect to the axial direction A1. As shown in FIGS. 2 and 3, the decompression mechanism D3 is opposite the second end bearing 66 and the second end journal 63 with respect to the pump cam 68 and the axial direction A1, and is adjacent to the upper end of the pump cam 68.

Referring to FIGS. 5 and 6, the decompression mechanism D3 is mounted on the camshaft 31 such that the axis L4 of swing motion of the centrifugal weight 91 is perpendicular to a reference line L5 connecting the axis L2 of rotation and the tip Np1 of the cam lobe Np as viewed along the axial direction A1, and the centrifugal weight 91 is substantially symmetrical with respect to the reference line L5. The centrifugal weight 91 including the center G of gravity is disposed on the cam lobe side of the pump cam 68, i.e., on the side of the center F of the pump cam 68 with respect to the axis L2 of rotation as viewed from the axial direction A1. The term "cam lobe side" signifies one side on which the cam lobe N0 or the tip Np1 lies with respect to a plane including the axis L2 of rotation and perpendicular to the reference line L5.

When the centrifugal weight 91 turns from the operative position toward the inoperative position as the rotating speed of the camshaft 31 increases, the centrifugal weight 91 turns toward the tip Np1 of the cam lobe Np relative to the axis L2 of rotation of the camshaft 31 as viewed from the axial direction A1. More concretely, the centrifugal weight 91 turns toward the tip Np1 of the cam lobe Np along the reference line L5.

As shown in FIGS. 6, 7A and 7B, the outermost position, with respect to a direction along the diameter of the camshaft 31, of the outer surface 91*c*3 of the centrifugal weight 91 of the decompression mechanism D3 when the centrifugal weight 91 is at the inoperative position coincides substantially with that of the outermost part of the centrifugal weight 91 at the operative position. Therefore, the decompression mechanism D3 including the centrifugal weight 91, in either an operative state or an inoperative state, is contained entirely in a projection of the pump cam 68 on a plane perpendicular to the axial direction A1; that is, the centrifugal weight 91 swings in a range corresponding to the cam surface 68*b* of the pump cam 68 or in a range overlapping the pump cam 68. The centrifugal weight 91 swings inside a range in which the cam lobe N0 is formed at least on the cam lobe side.

The operation and effect of the embodiment will be described.

The pump cam 68 for driving the fuel pump 74 abuts on the second end bearing 66 supporting the second end journal 63 of the camshaft 31 and serves as a thrust bearing member for restraining the camshaft 31 from downward movement. The decompression mechanism D3 associated with the third cylinder C3, i.e., the bottom cylinder, is disposed opposite the second end bearing 66 with respect to the axial direction A1 relative to the pump cam 68 and is adjacent to the upper side of the pump cam 68. Since the pump cam 68 servers also as a thrust bearing member, an additional space in the axial direction A1 along the camshaft 31, which is not available when both a pump cam and a thrust bearing member are formed on the camshaft 31, is available, and the decompression mechanism D3 can be disposed near the pump cam 68 with respect to the axial direction A1. Thus, increase in the length of the camshaft 31 provided with the pump cam 68 and the decompression mechanism D3 and in the axial dimension of the valve chamber 30 can be suppressed, and the internal combustion engine E can be formed in compact construction.

The pump cam 68 for driving the fuel pump 74 is in contact with the second end bearing 66 among the three bearings 64, 65 and 66 supporting the three journals 61, 62 and 63 of the camshaft 31 and serves as a thrust bearing member that restrains the camshaft 31 from downward movement. Further, the pump cam 68, the intake cam 51, the exhaust cam 52 and the decompression mechanism D3 associated with the third cylinder C3 are arranged between the second end bearing 66 and the middle bearing 65, and the exhaust cam 52 is adjacent to the pump cam 68 on the upper side of the second end bearing 66. Thus, a space in the axial direction A1 along the camshaft 31, which is not available when a pump cam and a thrust bearing member are formed separately between the second end bearing 66 and the middle bearing 65 respectively on the opposite sides of the third cylinder C3, is available, and the intake cam 51, the exhaust cam 52 and the decompression mechanism D3 can be disposed near the pump cam 68. Thus, increase in the length of the camshaft 31 provided with the pump cam 68 and the decompression mechanism D3 and in the axial dimension of the valve chamber 30 can be suppressed, and the internal combustion engine E can be formed in compact construction.

The connecting member 36 connecting the camshaft 31, and the shaft 37*a* of the oil pump 37 coincides with the second end journal 63 and the second end bearing 66 with respect to the axial direction A1, which also suppresses increase in the length of the camshaft 31.

The centrifugal weight 91, supported for turning on the camshaft 31 adjacently to the pump cam 68 with respect to the axial direction A1, of the decompression mechanism D3 is on the same side as the cam lobe of the pump cam 68 as viewed from the axial direction A1, and turns toward the tip Np1 of the cam lobe Np relative to the axis L2 for rotation along the reference line L5. Thus, the centrifugal weight 91 is disposed on the cam lobe side toward the tip Np1 farthest from the axis L2 of rotation. Therefore, the range of swing motion in which the centrifugal weight 91 turns until the same overlaps the cam surface 68*b* of the pump cam 68 as viewed from the axial direction A1 is larger than a swing range in which a centrifugal weight disposed outside the cam lobe side turns radially outward. Thus, decompression mechanism D3 can be disposed near the pump cam 68, avoiding interference between the centrifugal weight 91 and the swing arm 79 in the range of swing motion of the centrifugal weight 91. Consequently, increase in the length of the camshaft 31 and in the axial dimension of the valve chamber 30 can be suppressed, and the internal combustion engine E can be formed in compact construction.

Since the centrifugal weight 91, disposed near the pump cam 68 with respect to the axial direction A1, and supported on the camshaft 31 so as to be radially movable, of the decompression mechanism D3 moves inside a range defined by the cam surface 68*b* of the pump cam 68 as viewed from the axial direction A1, the centrifugal weight 91 does not project outward from the cam surface 68*b*. Thus, the decompression mechanism D3 can be disposed near the pump cam 68, avoiding interference between the centrifugal weight 91 and the swing arm 79 in the range of swing motion of the centrifugal weight 91. Consequently, increase in the length of the camshaft 31 and in the axial dimension of the valve chamber 30 can be suppressed, and the internal combustion engine E can be formed in compact construction.

Since the centrifugal weight 91 swings within a range corresponding to the cam lobe Np and defined by the angular range of the cam lobe Np, increase in the radial dimension of the pump cam 68 can be avoided.

The decompression mechanism D3 is disposed near the second end journal 63 between the pump cam 68 for driving the actuating rod 78 of the fuel pump through the swing arm 79, and the exhaust cam 52 for opening and closing the exhaust valve 44 interlocked with the decompression mechanism D3, and the swing arm 79 has the contact tip 79*b* in contact with the cam surface 68*b* of the pump cam 68, and the pushing tip 79*a* in contact with the tip of the end part 78*b*1 of the actuating rod 78. Therefore, the actuating rod 78 and the tubular projection 75*a*2, projecting into the valve chamber 30, of the fuel pump 74 can be disposed apart from the lower wall 4*b* of the cylinder head 4 with respect to the axial direction A1, and can be prevented from interference with the head bolt B1*b* and the boss S2 at positions coinciding with the pump cam 68 with respect to the axial direction A1. Thus, increase in the length of the camshaft 31, and the projection in the axial direction A1 of the fuel pump 74 from the cylinder head 4 can be suppressed and the internal combustion engine E can be formed in compact construction.

The valve train V includes the camshaft 31 provided with the intake cams 47, 49 and 51 for driving the intake rocker arms 55, 57 and 59 to open and close the intake valves 43, and the exhaust cams 48, 50 and 52 for driving the exhaust rocker arms 56, 58 and 60 to open and close the exhaust valves 44 for the cylinders C1 to C3. The exhaust cam 50 for opening and closing the exhaust valve 44 operated for opening and closing by the decompression mechanism D2 for the second cylinder C2, i.e., the middle cylinder at the middle of the cylinder row, does not coincide with the end 44A of the valve stem of the exhaust rocker arm 58 in contact with the tip 58*a*1 of the adjusting screw 58*a* with respect to the axial direction A1. The decompression mechanism D2 coincides with the end 44A of the valve stem of the exhaust valve 44 with respect to the axial direction A1. The axis L4 of swing motion of the decompression mechanism D2 lies in the axial range between the slipper 58*b* of the exhaust rocker arm 58, and the adjusting screw 58*a*, the end 44A of the valve stem of the exhaust valve 44 coincides with the centrifugal weight 91 of the decompression mechanism D2 with respect to the axial direction A1, and most part of the decompression mechanism D2, i.e., part between the decompression cam 92 and more than half part of the centrifugal weight 91, coincides with the exhaust rocker arm 58 with respect to the axial direction A1. Therefore, the exhaust cam 50 can be offset from the end 44A of the valve stem of the exhaust valve 44 to a position not coinciding with the end 44A of the valve stem of the exhaust cam 44 with respect to the axial direction, and the decompression mechanism D2 is disposed so as to coincide with the end 44A of the valve stem of the exhaust valve 44 with respect to the axial direction A1 by using an axial space provided by offsetting the exhaust cam 50. Thus, a sufficient space is available for disposing the decompression mechanism D2, increase in the length of the camshaft 31 extending across the three cylinders C1, C2 and C3, and increase in the axial dimension of the valve chamber 30 in the axial direction A1 can be suppressed, and the internal combustion engine can be formed in compact construction.

The exhaust cam 50 for the second cylinder C2 is offset toward the first cylinder C1 relative to the end 44A of the valve stem of the exhaust valve 44. The cylindrical part 31*c* of the camshaft 31 extends between the intake cam 49 for the second cylinder C2 and the decompression mechanism D1 for the first cylinder D1, and is not provided with any journal to be supported by a bearing. Thus, the axial space in the axial direction A1 is available in the cylindrical part 31*c*. This space enables offsetting the exhaust cam 50 relative to the end 44A of the valve stem of the exhaust valve 44. Thus, increase in the length of the camshaft 31 and in the axial dimension of the valve chamber 30 can be suppressed and the internal combustion engine E can be formed in compact construction.

The intake cam 49 formed on the camshaft 31 for the second cylinder C2 is adjacent to the decompression mechanism D1 for the first cylinder C1, and any journals and such that prevent forming the intake cams 47 and 49, the exhaust cams 48 and 50 or the decompression mechanisms D1 and D2 associated with the cylinders C1 and C2 from being adjacently formed are not formed on the camshaft 31. Therefore, a sufficient space is available for disposing the decompression mechanisms D1 and D2. Thus, increase in the length of the camshaft 31 and in the axial dimension of the valve chamber 30 can be suppressed and the internal combustion engine E can be formed in compact construction.

A cylindrical part 31*d* of the camshaft 31 extends between the decompression mechanism D2 associated with the second cylinder C2, and the intake cam 51 for the third cylinder C3, and the middle bearing 65 is formed at the position corresponding to the cylindrical part 31*d*. Consequently, the deformation of the camshaft 31 due to loads on the intake cams 47, 49 and 51, and those on the exhaust cams 48, 50 and 52 can effectively prevented, and hence the stable operation of the valve train V can be ensured while the internal combustion engine E is operating at high engine speeds.

Modifications of the foregoing embodiment will be described.

The middle bearing 65 may be disposed between the first cylinder C1 and the second cylinder C2 instead of between the second cylinder C2 and the third cylinder C3. If the middle bearing 65 is disposed so, the intake cam 49, the exhaust cam 50 and the decompression mechanism associated with the second cylinder C2 are formed in the same shapes and arranged in the same arrangement as those associated with the first cylinder C1, the third cylinder C3 is a specific cylinder, and the intake rocker arm 59 and the exhaust rocker arm 60 for the third cylinder C3 are specific rocker arms, and the intake cam 51, the exhaust cam 52 and the decompression mechanism D3 are formed in the same shapes and arranged in the same arrangement as the intake cam 49, the exhaust cam 50 and the decompression mechanism D2 for the second cylinder C2 in the foregoing embodiment.

The decompression mechanisms D1 to D3 may open the intake valves 43 instead of the exhaust valves 44. If the decompression mechanisms D1 to D3 operate so, the intake cams are specific cams.

If the decompression mechanism D3 opens the intake valve 43 for the third cylinder C3, the decompression mechanism D3 may be disposed adjacently to the intake cam 51 below the intake cam 51, the exhaust rocker arm 60 may be formed in the specific rocker arm, the exhaust cam 52 may be disposed adjacently to and above the pump cam 68, the decompression mechanism D3 may be disposed above the exhaust cam 52, and the intake cam 51 may be formed above the decompression mechanism D3 between the intermediate bearing 65 and the second end bearing 66.

Depending on the arrangement of the intake cam 51 and the exhaust cam 52 for the third cylinder C3 dependent on the arrangement of the intake valve 43 and the exhaust valve 44, the intake valve 43 or the exhaust valve 44 may be disposed opposite the second end bearing 66 with respect to the axial direction A1 relative to the pump cam 68 and adjacently to the pump cam 68 when the intake valve 43 is opened by the decompression mechanism D3 disposed below the intake cam 51.

Although the centrifugal weight 91 is pivotally supported on the camshaft 31 so as to turn radially outward in the foregoing embodiment, the centrifugal weight 91 may be supported for sliding.

The fuel pump 74 may be attached to the head cover 5, i.e., a valve chamber forming member combined with the cylinder head 4 to form the valve chamber 30. The specific bearing may be the first end bearing 64 or the middle bearing 65 instead of the second end bearing 66.

The internal combustion engine may be a single-cylinder internal combustion engine or a multi-cylinder internal combustion engine other than a three-cylinder internal combustion engine. The internal combustion engine is not limited to a vertical internal combustion engine and may be an internal combustion engine for conveyances including vehicles other than the outboard engine, and stationary machines.

Although there have been described what are the present embodiments of the invention, it will be understood that variations and modifications may be made thereto without departing from the spirit or essence of the invention.

What is claimed is:

1. An internal combustion engine comprising:

three or more cylinders arranged in parallel;

a crankshaft driven for rotation by pistons that reciprocate in the cylinders;

a camshaft supported for rotation, interlocked with the crankshaft and extending across all the cylinders;

a valve chamber forming member forming a valve chamber to contain the camshaft;

a valve train disposed in the valve chamber to open and close intake valves and exhaust valves; and decompression mechanisms, respectively for the cylinders, arranged in the valve chamber to open the intake valves or the exhaust valves during a compression stroke;

wherein the valve train includes the camshaft, and valve cams formed on the camshaft for the cylinders to open and close the intake valves and the exhaust valves through valve-operating members, a specific one, corresponding to a specific one of the cylinders, among the valve cams is located at a position not coincident with respect to an axial direction parallel to the axis of the camshaft with a position where an abutment portion, in contact with the valve-operating member, of the intake valve or the exhaust valve is located, and the decompression mechanism for the specific cylinder is located at a position coincident with respect to the axial direction with the position of the abutment portion of the intake valve or the exhaust valve.

2. The internal combustion engine according to claim 1, wherein the specific cylinder is an intermediate one of the cylinders.

3. The internal combustion engine according to claim 1, wherein the specific valve cam is offset toward the cylinder adjacent to the specific cylinder relative to the abutment portion of the intake valve or the exhaust valve, and a part of the camshaft, extending between the specific valve cam or the decompression mechanism for the specific cylinder, and the valve cam or the decompression mechanism for the cylinder adjacent to the specific cylinder, lacks any bearing for supporting said part of the camshaft.

4. The internal combustion engine according to claim 1, wherein the specific cylinder is an intermediate one of the cylinders, a part of the camshaft, extending between the specific valve cam or the decompression mechanism for the specific cylinder, and the valve cam or the decompression mechanism for one of the two cylinders on the opposite sides of the specific cylinder, lacks a bearing for supporting said part of the camshaft, and another part of the camshaft, extending between the specific valve cam or the decompression mechanism for the specific cylinder, and the valve cam or the decompression mechanism for the other one of the two cylinders on the opposite sides of the specific cylinder, is supported for rotation in a camshaft bearing.

5. The internal combustion engine according to claim 1, wherein the valve cam or the decompression mechanism for the specific cylinder is disposed adjacently to the valve cam or the decompression mechanism for cylinder adjacent to the specific cylinder.

6. An internal combustion engine comprising:

cylinders;

a crankshaft driven for rotation by pistons that reciprocate in the cylinders;

a camshaft supported for rotation, and interlocked with the crankshaft;

a valve chamber forming member forming a valve chamber to contain the camshaft;

a valve train disposed in the valve chamber to open and close intake valves and exhaust valves;

decompression mechanisms, respectively for the cylinders, arranged in the valve chamber to open the intake valves or the exhaust valves during a compression stroke; and a fuel pump attached to the valve chamber forming member forming the valve chamber;

wherein the camshaft is provided with a pump cam having a cam surface with which a pump-operating member for driving the fuel pump comes into contact to drive the fuel pump, and one of the decompression mechanisms is provided with a centrifugal weight supported on the camshaft for turning and disposed adjacent to the pump cam with respect to an axial direction parallel to the axis of the camshaft, the centrifugal weight is on a side of a cam lobe defined by the cam surface of the pump cam as viewed in the axial direction, and the centrifugal weight turns toward the axis of the camshaft so as to approach a tip part of the cam lobe of the pump cam as the rotational speed of the camshaft increases.

7. An internal combustion engine comprising:

cylinders;

a crankshaft driven for rotation by pistons that reciprocate in the cylinders;

a camshaft supported for rotation, and interlocked with the crankshaft;

a valve chamber forming member forming a valve chamber to contain the camshaft;

a valve train disposed in the valve chamber to open and close intake valves and exhaust valves;

decompression mechanisms, respectively for the cylinders, arranged in the valve chamber to open the intake valves or the exhaust valves during a compression stroke; and a fuel pump attached to the valve chamber forming member forming the valve chamber;

wherein the camshaft is provided with a pump cam having a cam surface with which a pump-operating member for driving the fuel pump comes into contact to drive the fuel pump, and one of the decompression mechanisms is provided with a centrifugal weight supported on the camshaft for radial movement and positioned adjacent to the pump cam with respect to an axial direction parallel to the axis of the camshaft, and the centrifugal weight moves in a range corresponding to the cam surface of the pump cam as viewed in the axial direction.

8. The internal combustion engine according to claim 1, further including:

a fuel pump attached to the valve chamber forming member forming the valve chamber;

wherein the camshaft is provided with a pump cam having a cam surface with which a pump-operating member for driving the fuel pump comes into contact to drive the fuel pump, and one of the decompression mechanisms is provided with a centrifugal weight supported on the camshaft for turning and disposed adjacent to the pump cam with respect to an axial direction parallel to the axis of the camshaft, the centrifugal weight is on a side of a cam lobe defined by the cam surface of the pump cam as viewed in the axial direction, and the centrifugal weight turns toward the axis of the camshaft so as to approach a tip part of the cam lobe of the pump cam as the rotational speed of the camshaft increases.

9. The internal combustion engine according to claim 1, further including:

a fuel pump attached to the valve chamber forming member forming the valve chamber;

wherein the camshaft is provided with a pump cam having a cam surface with which a pump-operating member for driving the fuel pump comes into contact to drive the fuel pump, and one of the decompression mechanisms is provided with a centrifugal weight supported on the camshaft for turning and disposed adjacent to the pump cam with respect to an axial direction parallel to the axis of the camshaft, and the centrifugal weight moves in a range corresponding to the cam surface of the pump cam as viewed in the axial direction.

* * * * *

UNITED STATES PATENT AND TRADEMARK OFFICE

CERTIFICATE OF CORRECTION

PATENT NO. : 6,868,835 B2
DATED : March 22, 2005
INVENTOR(S) : Masanori Tsubouchi It is certified that error appears in the above-identified patent and that said Letters Patent is hereby corrected as shown below:

Column 10,
Line 16, change “opens” to -- open --.

Column 13,
Line 18, change “oil flowed” to -- oil having flowed --.

Column 20,
Line 20, change “the first cylinder Dl” to -- the first cylinder Cl --.

Column 22,
Line 42, change “for cylinder adjacent” to -- for a cylinder adjacent --.

Signed and Sealed this

Twenty-eighth Day of June, 2005

JON W. DUDAS
*Director of the United States Patent and Trademark Office*